US009795984B2

(12) United States Patent
Hoppel et al.

(10) Patent No.: US 9,795,984 B2
(45) Date of Patent: Oct. 24, 2017

(54) METHOD AND APPARATUS FOR COATING HORIZONTAL SURFACES

(71) Applicants: Steffon L. Hoppel, Louisville, OH (US); James W. Davidson, Hartville, OH (US)

(72) Inventors: Steffon L. Hoppel, Louisville, OH (US); James W. Davidson, Hartville, OH (US)

( * ) Notice: Subject to any disclaimer, the term of this patent is extended or adjusted under 35 U.S.C. 154(b) by 0 days.

(21) Appl. No.: 14/582,362

(22) Filed: Dec. 24, 2014

(65) Prior Publication Data

US 2015/0110950 A1 Apr. 23, 2015

Related U.S. Application Data

(62) Division of application No. 13/293,482, filed on Nov. 10, 2011, now abandoned.

(51) Int. Cl.

| | |
|---|---|
| ***B05B 13/04*** | (2006.01) |
| ***B05C 9/12*** | (2006.01) |
| ***B05B 12/08*** | (2006.01) |
| ***B05B 12/12*** | (2006.01) |
| ***B05D 1/00*** | (2006.01) |
| ***B05B 12/10*** | (2006.01) |
| *E01C 23/22* | (2006.01) |
| *B05B 13/00* | (2006.01) |

(52) U.S. Cl.

CPC ..... *B05C 9/12* (2013.01); *B05B 12/084* (2013.01); *B05B 12/10* (2013.01); *B05B 12/12* (2013.01); *B05B 12/122* (2013.01); *B05B 13/041* (2013.01); *B05D 1/00* (2013.01); *B05B 12/081* (2013.01); *B05B 12/085* (2013.01); *B05B 13/005* (2013.01); *E01C 23/22* (2013.01); *E01C 23/222* (2013.01)

(58) Field of Classification Search

CPC ..... E01C 23/22; E01C 23/222

See application file for complete search history.

(56) References Cited

U.S. PATENT DOCUMENTS

| | | | | |
|---|---|---|---|---|
| 2,789,485 | A | 4/1957 | Lingren | |
| 4,167,151 | A * | 9/1979 | Muraoka | B01F 15/0237 118/323 |
| 4,411,554 | A | 10/1983 | Gratzfeld | |
| 4,541,750 | A | 9/1985 | Owens | |
| 4,710,054 | A | 12/1987 | Allen | |
| 5,102,045 | A | 4/1992 | Diana | |
| 5,109,791 | A | 5/1992 | Matsumoto et al. | |
| 5,529,433 | A * | 6/1996 | Huynh | E01C 23/222 404/101 |
| 6,036,123 | A | 3/2000 | West | |
| 6,090,203 | A | 7/2000 | Gebhardt et al. | |
| 6,128,081 | A * | 10/2000 | White | G01B 11/0666 356/432 |
| 6,497,531 | B2 | 12/2002 | Sipherd | |
| 6,562,139 | B2 | 5/2003 | Morton | |

(Continued)

FOREIGN PATENT DOCUMENTS

| | | |
|---|---|---|
| JP | 1004273 | 1/1989 |

*Primary Examiner* — Michael P Rodriguez

(74) *Attorney, Agent, or Firm* — Sand & Sebolt

(57) ABSTRACT

A coating apparatus and method allow for precise control of the application of a coating material on a substrate and provides a data recording system which is useful for certifying a coating job and assessing when and where any abnormalities occur.

22 Claims, 12 Drawing Sheets

(56) References Cited

U.S. PATENT DOCUMENTS

| | | | | |
|---|---|---|---|---|
| 6,832,864 | B2 | 12/2004 | Patton et al. | |
| 6,981,657 | B1 | 1/2006 | West | |
| 7,118,629 | B2 * | 10/2006 | Davidson | B05B 13/041 118/305 |
| 2002/0108692 | A1 | 8/2002 | Hunter | |
| 2005/0081782 | A1 * | 4/2005 | Buckley | A47L 11/03 118/207 |
| 2006/0165874 | A1 | 7/2006 | Erdman | |
| 2007/0208157 | A1 * | 9/2007 | Posey | C08G 18/3821 528/44 |
| 2009/0013928 | A1 * | 1/2009 | Nielsen | B65D 83/203 118/305 |
| 2010/0189887 | A1 * | 7/2010 | Nielsen | G01C 15/02 427/136 |
| 2010/0330292 | A1 | 12/2010 | Endregaard et al. | |

* cited by examiner

METHOD AND APPARATUS FOR COATING HORIZONTAL SURFACES

CROSS REFERENCE TO RELATED APPLICATION

This application is a division of U.S. patent application Ser. No. 13/293,482, filed Nov. 10, 2011; the disclosure of which is incorporated herein by reference.

BACKGROUND OF THE INVENTION

1. Technical Field

The present invention is related generally to a method and apparatus for applying a coating material to a substrate such as a horizontal surface. More particularly, the invention relates to such a method and apparatus for applying the coating material in an efficient manner and for recording data which is related to the application process and may be used in discovering causes for problems associated with the application process.

2. Background Information

A variety of coating devices are known in the art for applying a coating material to a desired substrate. Such devices include those which apply solid particulate material to the substrate as well as those which apply a coating material in the form of liquid droplets, as with sprayers which may use various types of nozzles or sprayer heads. Although such devices have substantially improved the efficiency with which a given coating material may be applied to the substrate compared to the efficiency produced by handheld coating applicators, there is still a need for such a device which applies the coating material in a highly efficient manner, especially in light of the very high cost for certain types of coating materials. Prior art devices include those which use a coating applicator which moves back and forth such that the coating material is applied in a zigzag fashion. This type of coating pattern is satisfactory in many instances, but is still not the most efficient. In addition, when a coating material is applied incorrectly by a standard coating applicator, it is a guessing game as to the problem which caused the incorrect application. Thus, there is a need in the art for a coating device which addresses this problem as well.

BRIEF SUMMARY OF THE INVENTION

The present invention provides an apparatus comprising a frame; a travel advancement mechanism mounted on the frame adapted to move the frame forward relative to a substrate; a coating applicator which is mounted on the frame, movable relative to the frame laterally back and forth between left and right positions, and adapted to apply a coating material to the substrate; and a data recording device operatively connected to the applicator for recording data concerning operation of the applicator.

The present invention also provides a method comprising the steps of creating relative axial movement between a coating apparatus frame and a substrate; driving a coating applicator longitudinally back and forth along the frame; applying a coating material to the substrate with the applicator; and recording with a recording device data concerning application of the coating material.

The present invention further provides an apparatus comprising a frame; a travel advancement mechanism mounted on the frame adapted to move the frame forward relative to a substrate; a coating applicator which is mounted on the frame, movable relative to the frame laterally back and forth between left and right positions, and adapted to apply a coating material to the substrate; a control device operatively connected to and configured to control the travel advancement mechanism to move the frame forward a predetermined distance (a) while the sprayer is adjacent the left position and (b) while the sprayer is adjacent the right position so that the coating applicator moves (i) along a first path from the left position to the right position and (ii) along a second path from the right position to the left position wherein the second path is forward of, adjacent and parallel to the first path.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

FIG. 5 also shows the position in which the forward movement of the coating apparatus has stopped and the position of the applicator at about the beginning of the application of the next ribbon of material to the substrate.

FIG. 8 is analogous to FIG. 2 and illustrates the completion of a full cycle of movement of the coating apparatus and coating applicator relative to the position shown in FIG. 2 whereby the coating apparatus has applied the first ribbon of material to the substrate from right to left, a left end segment as the coating apparatus moves forward, a second ribbon from the left to the right and a right end segment as the coating apparatus moves forward whereby FIG. 8 also shows the beginning of the next full cycle of the application of the material to the substrate.

FIG. 9 is analogous to FIG. 3 with respect to the movement of the coating applicator from the right to the left and the application of the coating material to the substrate except that FIG. 9 shows this process occurring at a location forward of the location shown at FIG. 3.

FIG. 10 thus shows, since the starting position of FIG. 1, four full cycles of coating application and about ¾ of the next cycle.

FIG. 11 also serves as one example of a graph or visual representation pinpointing where errors or abnormalities occurred during the coating process.

Similar numbers refer to similar parts throughout the drawings.

DETAILED DESCRIPTION OF THE INVENTION

Figures 1, 1A:
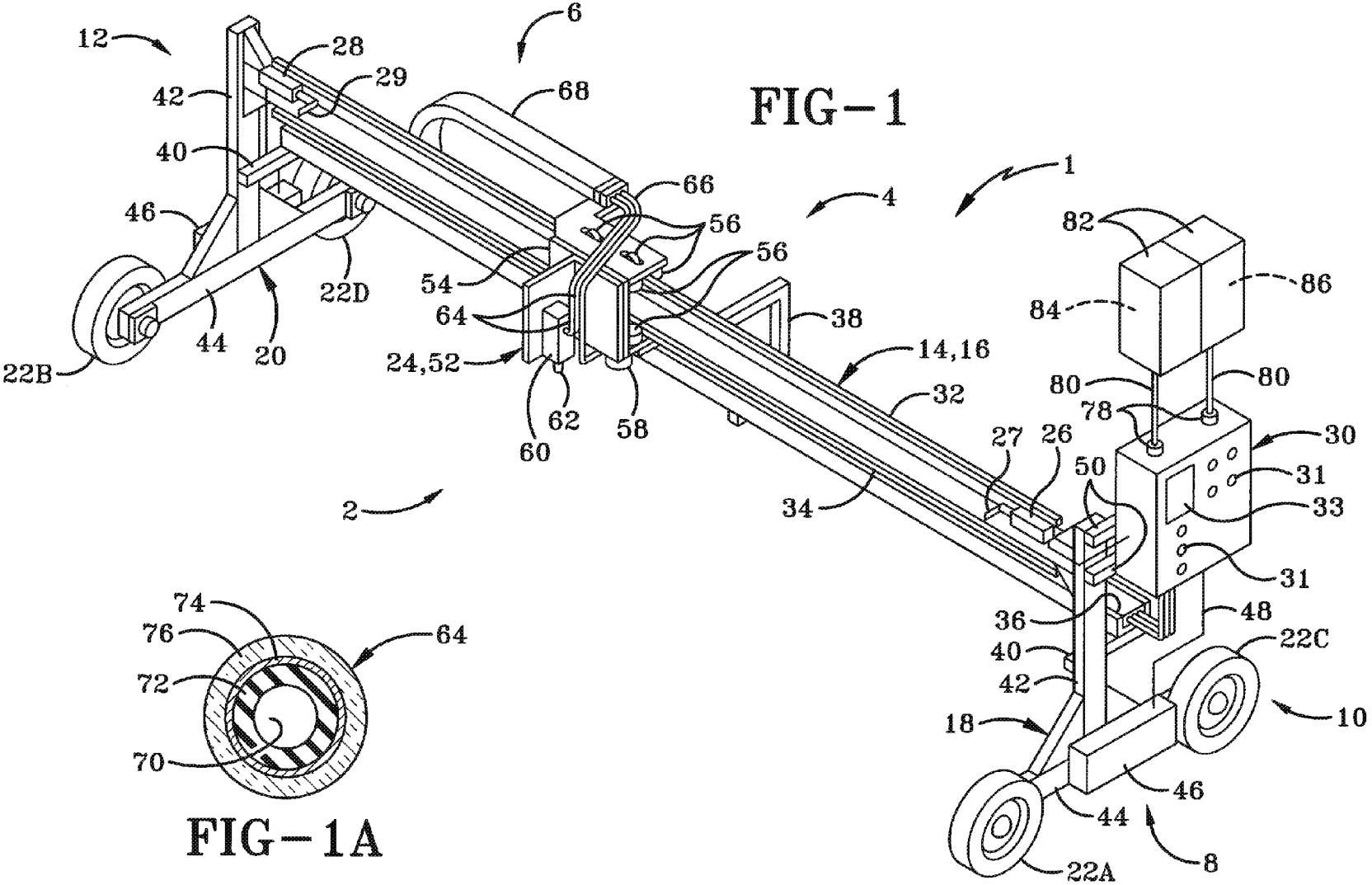
FIG. 1 is a perspective view of the coating apparatus of the present invention showing the material supply containers in a diagrammatic perspective fashion.
FIG. 1A is a cross sectional view of one of the material feed lines.

The coating apparatus of the present invention is shown generally at 1 in FIG. 1, and is in the exemplary embodiment in the form of a vehicle configured for forward and rearward movement. Apparatus 1 has a front 2, a back 4, a top 6, a bottom 8, and left and right sides or ends 10 and 12 defining therebetween a longitudinal direction. Front 2 and back 4 define therebetween an axial direction. Apparatus 1 includes a rigid frame 14 typically formed primarily of metal. Frame 14 includes a longitudinally elongated elevated rigid structure 16 which extends from adjacent left side 10 to adjacent right side 12. Frame 14 further includes rigid left and right supports 18 and 20 rigidly secured respectively to the left and right sides or ends of structure 16. Apparatus 1 also includes a travel advancement mechanism which in the exemplary embodiment includes four ground engaging wheels 22. Wheels 22 more particularly include a left front wheel 22A, a right front wheel 22B, a left rear wheel 22C and a right rear wheel 22D. The left wheels 22A and C are rotatably mounted on left support 18 while the right wheels 22B and D are rotatably mounted on right support 20. Although wheels are used in the exemplary embodiment, wheels 22 may be replaced by a different mechanism for effecting the forward and rearward movement of apparatus 1, such as revolving tracks or the like. Apparatus 1 further includes a coating applicator assembly 24 which is mounted on and movable relative to structure 16 back and forth to the left and right. A left sensor 26 is mounted on structure 16 adjacent the left end thereof. Likewise, a right sensor 28 is mounted on structure 16 and adjacent the right end thereof such that assembly 24 is movable back and forth between and alternately engagable with sensors 26 and 28. More particularly, sensors 26 and 28 respectively have arms or switches 27 and 29 which assembly 24 alternately engages between movement thereof. Sensors 26 and 28 are mounted so that they remain fixed on frame 14 during the coating process. However, sensors 26 and 28 may be adjustable such that they can be moved longitudinally to the left or right and secured at a desired position such that the lateral travel of assembly 24 may be shortened or lengthened between these sensors.

Apparatus 1 further includes a control device 30 mounted on left support 18 of the frame adjacent left side 10. In the exemplary embodiment, control device 30 includes a computer which is programmed to control the various functions of apparatus 1. Preferably, control device 30 includes operator input devices 31 which the operator can use in order to set all the pertinent control parameters related to apparatus 1. Input devices 31 may be used in part to program the computer to set the operational control parameters. Input devices 31 may include a scanner for scanning a label having specific information such as specifications of coating materials 84 and 86. Device 30 may include an onboard display screen or monitor 33. The computer of device 30 typically includes one or more interfaces for interfacing or communicating with the computer to allow the uploading or downloading of information either electrically via electrical connections or wirelessly via wireless connections. Apparatus 1 may further make use of the global positioning system (GPS) by carrying a GPS receiver or navigation device in communication with the computer of device 30.

Structure 16 includes a longitudinally elongated upper crossbar 32 which extends between and is rigidly secured to left and right supports 18 and 20 respectively at left and right ends thereof. Structure 16 also includes a longitudinally elongated U-shaped lower crossbar 34 which serves as an applicator hose or line support and which extends between and is rigidly secured at its left and right ends to left and right supports 18 and 20. The U-shaped support 34 defines a longitudinally elongated channel 36 extending from the left end to the right end thereof and which opens upwardly. A C-shaped central reinforcement bar 38 is rigidly secured to upper lower crossbars 32 and 34 at the longitudinal center of apparatus 1 midway between the left and right supports 18 and 20 to provide additional structural integrity between the crossbars.

Left and right supports 18 and 20 include left and right support arms 40 which are generally horizontal and rigidly secured to respective uprights 42 and extend rearwardly therefrom. Lower crossbar 34 is seated on and rigidly secured at its respective ends to the rear portions of arms 40. Supports 18 and 20 further include axial horizontal beams 44 such that uprights 42 are rigidly secured at their bottom ends to the center of beams 44 and extend upwardly therefrom. Wheels 22A and 22C are rotatably mounted respectively adjacent the front and rear ends of the left beam 44 while wheels 22B and 22D are similarly respectively mounted adjacent the front and rear ends of right beam 44. Wheels 22 rotate about horizontal longitudinally extending parallel axes. Left and right drive motors 46 are respectively mounted on left and right supports 18 and 20 and are in electrical or other communication with control device 30 such as via electrical wires 48. The left drive motor 46 is operatively connected to at least one of wheels 22A and 22C for driving rotation thereof. Likewise, the right motor 46 is operatively connected to at least one of wheels 22B and 22D to drive rotation thereof.

In short, control device 30 controls the operation of motors 46 in a specific manner such as by ramping up and ramping down the motors in order to control the rotation of wheels 22 typically in a synchronized manner at the same rate and for the same duration. More particularly, control device 30 is capable of controlling motors 46 to start rotation of wheels 22, stop rotation of wheels 22, control the rate of rotation and duration of rotation whereby control unit 30 controls the forward (or rearward) movement of vehicle 1 to include the starting and stopping of the vehicle as well as the rate of travel and the duration of travel and thus the distance traveled at a given time, as discussed further below. Motors 46 are thus part of the travel advancement mechanism to which control device 30 is operatively connected to control the travel advancement mechanism in a specification manner as described subsequently. In the exemplary embodiment, the control device 30 or control box is mounted on support arms 50 of the left support 18 wherein arms 50 are rigidly secured to and extend rearwardly from the top of the left upright 42.

Coating applicator assembly 24 includes an applicator carriage 52 having a rigid carriage body 54 typically formed primarily of metal with a plurality of rollers 56 rotatably mounted thereon. In the exemplary embodiment, some of these rollers rotate about horizontal axially extending axes, for instance the upper rollers such that the circular outer perimeters of the upper rollers rollingly engage the top upwardly facing surface of carriage track 32 during back and forth movement of carriage 52 along track 32. Others of these rollers rotate about vertical axes, such as front rollers such that the circular outer surfaces thereof rollingly engage a forward facing surface of track 32 and rear rollers whose circular outer surfaces rollingly engage a rearward facing surface of track 32 as carriage 52 moves back and forth to the left and to the right along track 32. In the exemplary embodiment, a carriage drive mechanism includes a carriage drive motor 58 secured to carriage body 54 for driving rotation of at least one of rollers 56 and thus driving the left and right movement of carriage 52 along track 32. Thus, one of the rollers 56 may be a drive roller while the remaining rollers are typically idler rollers. Furthermore, other carriage drive mechanisms may be used in order to drive the movement of carriage 52 back and forth along track 32. For instance, carriage 52 may be mounted on a belt or chain which is itself driven by a motor. The carriage and applicator drive mechanism and sensors 26 and 28 form part of a carriage and applicator travel control system for controlling the starting, stopping, duration and rate of travel of applicator assembly 24 via carriage 52.

Assembly 24 further includes a coating material discharge unit or coating applicator 60 which in the exemplary embodiment is in the form of a sprayer having a nozzle 62 through which material is discharged or sprayed to apply the material to substrate 3. In the exemplary embodiment, a pair of material feed lines 64 typically in the form of flexible hoses are provided for feeding material to applicator 60. Each of lines 64 is connected at one end to applicator 60 and have another end typically connected to or adjacent control unit 30. A flexible power and communication line 66 is connected at one end to motor 58 and another end is typically connected to control device 30 or is adjacent thereto. Motor 58 may be a pneumatic or hydraulic motor, whereby power line 66 may include a pneumatic or hydraulic hose for delivering pressurized air or hydraulic fluid to motor 58 to drive its operation whereby hose 66 is attached to a source of pressurized air or hydraulic fluid. Line 66 may also include electrical wires in electrical communication with motor 58 and the computer whereby the computer is able to control any electrical components of motor 58. Motor 58 may also be an electric motor whereby power line 66 typically takes the form of electric wires which are in electrical communication with a source of electric power. Typically, line 66 or another line for communication is connected to control device 30 such that device 30 is in communication with motor 58 whereby control device 30 is configured for controlling the operation of the motor including starting, stopping, rate of operation and duration of operation such that control device 30 likewise controls the movement of carriage 52 to the left or to the right along track 32. Control device 30 thus controls the movement of carriage 52 including starting, stopping, the rate of travel and duration of travel.

An elongated flexible line housing 68 is also provided to encase or house a substantial portion of lines 64 and 66 to facilitate the movement of portions of lines 64 and 66 as carriage 52 moves back and forth along track 32. In the exemplary embodiment, one end of housing 68 is adjacent the left end of crossbar 34. A segment of housing 68 extending from the left end 34 to and beyond bar 38 is disposed within channel 36 along with the corresponding segments of lines 64 and 66 and remains there throughout operation of apparatus 1. An additional portion of segment of housing 68, along with corresponding segments of lines 64 and 66, is generally disposed within the right half of channel 36 and moves into and out of channel 36 as carriage 52 moves back and forth along track 32. Housing 68 and lines 64 and 66 thus curve upwardly along the right half of structure 16 so that an upper end of housing 68 is secured to carriage body 54 and moves therewith along with the portions and lines of 64 and 66 adjacent carriage 52.

In the exemplary embodiment and with reference to FIG. 1A, each of lines 64 has a feed passage 70 defined by a flexible elastomeric hose 72 which is surrounded by a resistance heating wire or element 74, with a thermal insulation layer 76 which surrounds or encases element 74 and hose 72. Element 74 thus forms an intermediate layer between the inner layer formed by hose 72 and outer layer formed by insulation layer 76. Each hose 72, and the corresponding element 74 and insulation layer 76 extends continuously from one end of the given line 64 at or adjacent coating applicator 60 to the other opposed end of the given line 64 at or adjacent control box 30. Heating element 74 is operatively connected to the computer of control 30 so that the computer controls the electrical current to element 74 and consequently the degree of heat or thermal energy that element 74 provides to hose 72 and the given material 84, 86 within passage 72 in order to control the temperature of material 84, 86.

Returning to FIG. 1, a pair of hose connectors are provided on or adjacent control box 30 for connecting thereto a pair of hoses 80 at one end thereof so that hoses 80 are in fluid communication respectively with lines 64. Hoses 80 at their opposed ends are connected to a material supply source typically having one ore more containers 82. In the exemplary embodiment, hoses 80 are connected respectively to two separate containers 82 one of which contains a first liquid material such as a resin and the other of which contains a second liquid material such as a hardener or catalyst. Hoses 80 are thus respectively, in fluid communication with the two supply containers whereby lines 64 are likewise in fluid communication with the two supply containers. Containers 82 are thus in fluid communication with applicator 60 via feed lines 80, 64. Supply 82 may be carried onboard the vehicle 1 or may be positioned on the ground or elsewhere with flexible hoses 80 having a suitable length to allow the supply 82 to be stationary while vehicle 1 travels during its coating operation. The material supply 82 may also represent various equipment which isn't normally used as part of apparatus 1, or secondary equipment which a given user of apparatus 1 may attach thereto in order to provide the materials 84 and 86 as well as associated pumps, heaters, electric generators, air pressure sources and so forth used to facilitate the flow of materials through the feed lines of apparatus 1.

Apparatus 1 is provided with a variety of devices for controlling the various operations thereof and for recording information relevant to various operational parameters. Some of these devices are typically located in or adjacent control device 30 and are in electrical or other communication with the computer of control device 30: these devices typically include a humidity sensor for sensing the relative humidity of the ambient atmosphere where apparatus 1 is located during a given coating application job; an ambient temperature sensor for sensing the ambient temperature; a timer or clock which is typically part of the computer or may be separate from and in communication with the computer and facilitates tracking when all operations of vehicle 1 occur; a flow meter or flow gauge for each feed line 64 for measuring the flow rate of materials 84 and 86 respectively through the lines 64; a flow regulator for each of feed lines 64 for regulating the flow rate of materials 84 and 86 therethrough; a flow initiator control to control the start of material flow within lines of 64; a flow disruption or shut off control to control the stopping or ceasing of material flow within lines 64; a pressure gauge for each feed line 64 to determine the pressure under which materials 84 and 86 flow through feed lines 64; and a pump for pumping material 84, 86 through lines 64. Often, secondary equipment used with apparatus 1 includes a pump or source of compressed air associated with supply containers 82 whereby it is not necessary for apparatus 1 to have an onboard pump. The previously noted GPS receiver may be mounted adjacent control unit 30 or elsewhere on apparatus 1. Apparatus 1 or secondary equipment used therewith may include a thickness or depth sensor for sensing the thickness or depth of the coating applied to substrate 3.

Other similar devices are provided which are typically in other locations and likewise in electrical or other communication with the computer of control device 30: these devices typically include one or more temperature sensors at or adjacent applicator 60 to sense the temperature of materials 84 and 86 and/or 88 at or adjacent applicator 60; pressure gauges on each of containers 82 to determine the pressure therein and thus the pressure on materials 84 and 86 therein; temperature sensors adjacent containers 82 to determine the temperature of materials 84 and 86 within containers 82; volume meters or gauges on containers 82 to measure or sense the volume of material 84 and 86 within the respective container; heating or cooling devices for containers 82 to respectively heat or cool the contents of the containers including materials 84 and 86.

A forward axial travel rate meter may be provided to determine the speed or rate at which apparatus 1 travels forward. Such a meter may be provided in or adjacent one or more the wheel assemblies of wheels 22 and may be in the form of a meter which measures the rate of rotation of a given wheel 22, preferably including one meter for one of the right wheels 22B, 22D and for one of the left wheels 22A, 22C. A forward axial travel distance meter may also be provided to determine the forward distance that apparatus 1 travels. Such a meter may be a combination with the forward axial travel rate meter and for instance, measure the number of rotations or degree of rotation of a given wheel 22, again preferably including a meter for one of the right wheels 22B, 22D and a meter for one of the left wheels 22A, 22C. A lateral or longitudinal carriage and applicator travel rate meter may be provided to determine the speed or rate at which carriage 52 and applicator 60 travels laterally or longitudinally either in the left-to-right direction or the right-to-left direction. Such a meter may be provided in or adjacent one or more the roller assemblies of rollers 56 and may be in the form of a meter which measures the rate of rotation of a given roller 56. Also, a lateral or longitudinal carriage and applicator travel distance meter may be provided to determine the lateral or longitudinal distance which carriage 52 and applicator 60 travels in the left-to-right direction or the right-to-left direction. Such a meter may be in combination with the carriage and applicator travel rate meter, and for instance, measure the number of rotations or degree of rotation of a given roller 56.

Each of these travel rate or travel distance meters is in electrical or other communication with the computer of control unit 30. Thus, the travel rate meters can send to the computer signals indicative of the rates they measure or indicative of the rate of rotation of the corresponding wheel or roller. In the former case, the computer need not calculate the rate, whereas in the latter case, the computer is programmed to calculate the rate. Similarly, the travel distance meters can send to the computer signals indicative of the distances they measure or indicative of the number or degree of rotation of the corresponding wheel or roller. In the former case, the computer need not calculate the distance, whereas in the latter case, the computer is programmed to calculate the distance.

The operation of apparatus 1 is now described. Apparatus 1 is positioned adjacent substrate 3 and provided with one or more onboard or separate supply containers 82 connected as previously described via lines 80. The operator then sets the operational control parameters for a given coating job using a given coating material. More particularly, the operator uses control devices or input devices 31 to set the desired parameters of operation, thereby using a programmable computer program to created an operator-input job-specific computer program including control parameters to control: the travel drive mechanism for controlling starting, stopping, duration and rate of forward travel of vehicle 1; the carriage and applicator travel control system for controlling starting, stopping, duration and rate of longitudinal travel of coating applicator assembly 24; the pump and/or pressure source of containers 82 and/or the flow regulator for controlling the flow rate of materials 84 and 86 through feed lines 64, 80 from supply 82 to applicator 60; the heating or cooling devices of containers 82 and/or heating element 74 of one or both lines 64 for controlling the temperature range of materials 84 and 86 within containers 82 and/or lines 80 and 64, especially adjacent and thus just prior to discharge from applicator 60 as well as at the time of discharge and immediately after discharge.

Figure 2:
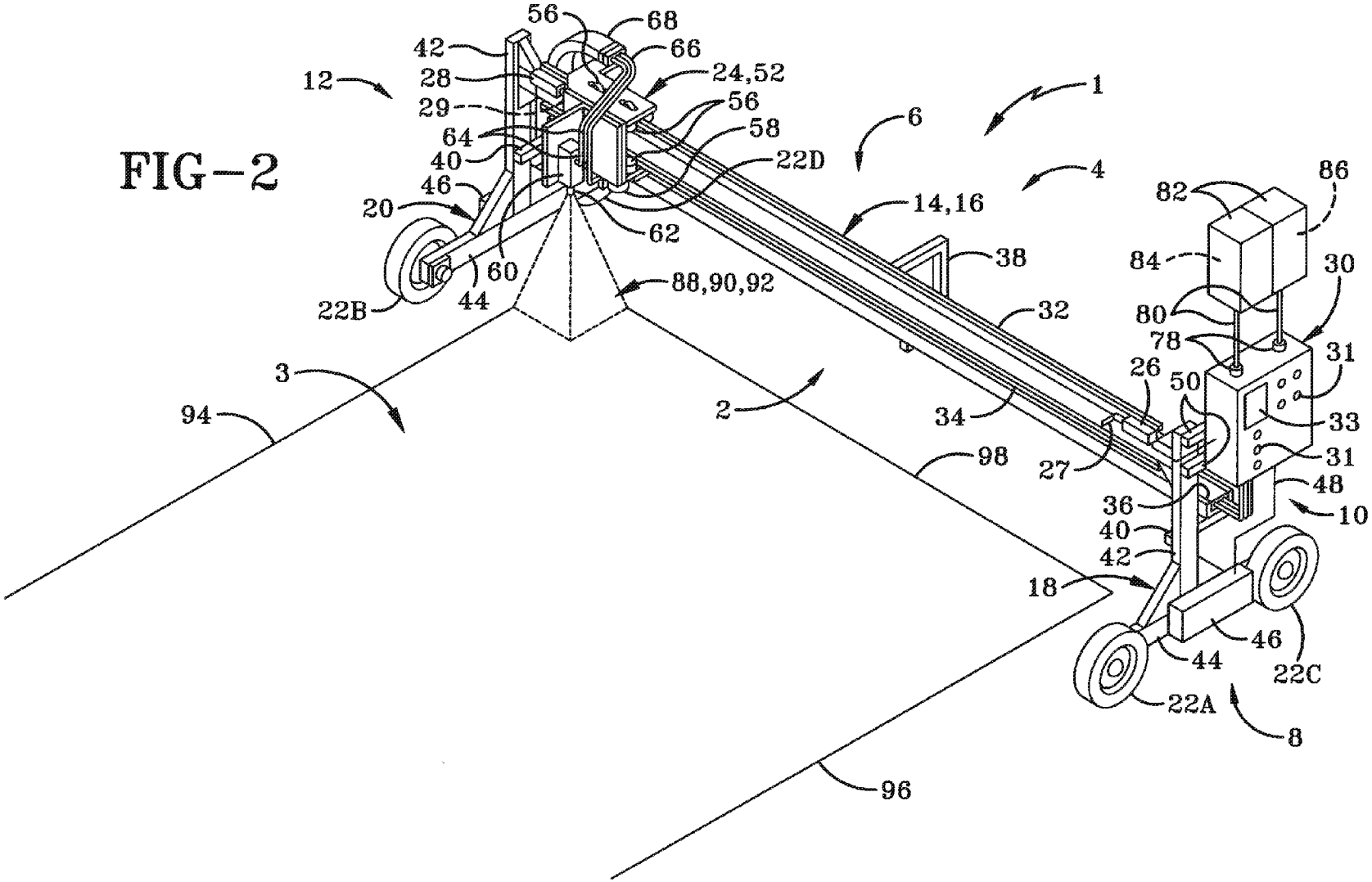
FIG. 2 is a perspective view of the coating apparatus at an initial stage of applying a layer of a coating material to a substrate.

Once the operator has set up applicator 1 including inputting all pertinent control parameters for a given application job via input devices 31 to program the computer of control device 30, coating applicator 1 is operated according to these set parameters of the computer program so that first material 84 flows from supply 82 through one of hoses 80 and the corresponding line 64 to applicator 60 while second material 86 flows from supply 82 through the other of hoses 80 and the other corresponding line 64 to applicator 60. Materials 84 and 86 are mixed by a mixing device within applicator 60 just prior to discharge from the applicator via nozzle 62. The mixing of materials 84 and 86 produces a mixed coating material 88 which is discharged by nozzle 62 in the form of a spray 90, as shown in FIG. 2 et seq. In the exemplary embodiment, first material 84 is a resin and second material 86 is a hardener or catalyst whereby the mixture 88 contains both the resin and hardener such that the hardener accelerates the curing or hardening of coating material 88 so that material 88 is applied in liquid form to substrate 3 and hardens or cures as a solid layer on substrate 3 relatively quickly. Although this curing time may vary greatly, it may occur, for instance, within only 15 to 30 or 60 seconds (such that a person can walk on the cured material 88 on substrate 3 without damaging the cured material).

In the exemplary embodiment, the operator's programming of the computer provides a computer program associated with applying a specific coating material to a specific substrate. The computer program controls coating apparatus 1 to provide a specific application pattern which facilitates maintaining a consistent thickness of the applied coating material on substrate 3 and allows for accurate recording of multiple operational parameters of apparatus 1 and certification of a given job. Unlike the zigzag pattern of prior art coating applicators, applicator 1 is preferably configured to provide straight parallel back-and-forth lateral coating segments, bands or ribbons along with relatively short left and right forward end segments which are perpendicular to the lateral ribbons and each of which connects an adjacent pair of parallel lateral ribbons respectively at the left and right ends thereof.

FIG. 2 shows coating apparatus 1 at an initial stage of applying coating material 88 to substrate 3. Apparatus 1 is at this initial stage stationary in the forward and rearward direction relative to substrate 3. More particularly, frame 14 and wheels 22 are stationary in all directions relative to substrate 3 and coating applicator 60 is at its rightmost position, having just started application of material 88 via spray 90 at an initial or starting position 92 of substrate 3. Initial position 92 is adjacent a right boundary or side 94 of substrate 3, distal a left boundary or side of substrate 3, and adjacent a lateral boundary or starting line 98 of substrate 3 which extends from right side 94 to left side 96. Simultaneous with the computer program controlling operation of applicator 60 to provide the initial spraying of material 88 at initial position 92, the computer program controls the applicator longitudinal drive mechanism including carriage drive mechanism or motor 58 to drive the initial straight leftward movement of carriage 52 and applicator 60 relative to stationary frame 14 and stationary substrate 3.

Figure 3:
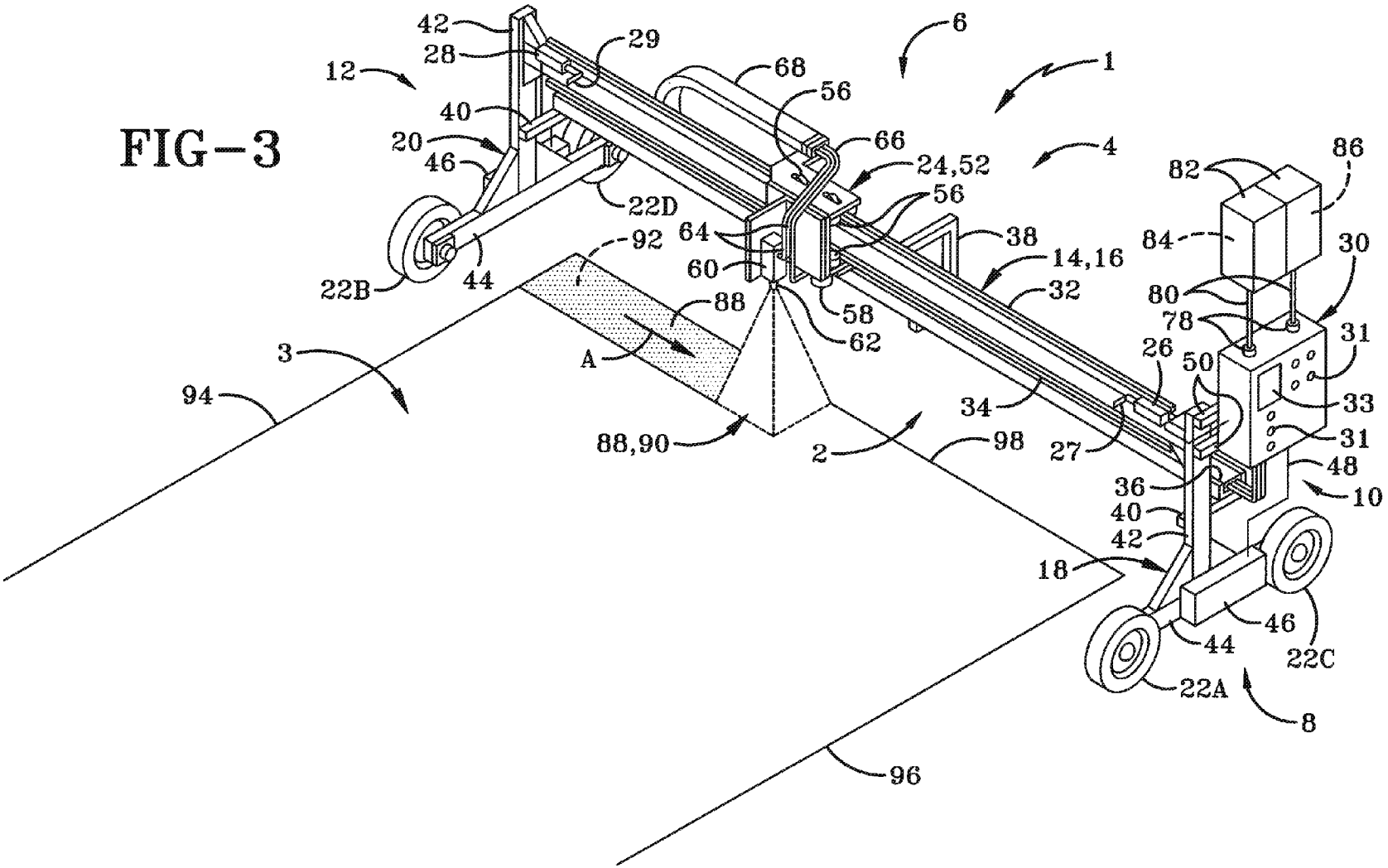
FIG. 3 is similar to FIG. 2 and shows a subsequent stage of application in which the applicator has moved from the rightmost position of FIG. 2 leftward so that the applicator is about midway between the left and right sides of the apparatus whereby about half of a first band or ribbon of coating material has been applied to the substrate.
Figure 4:
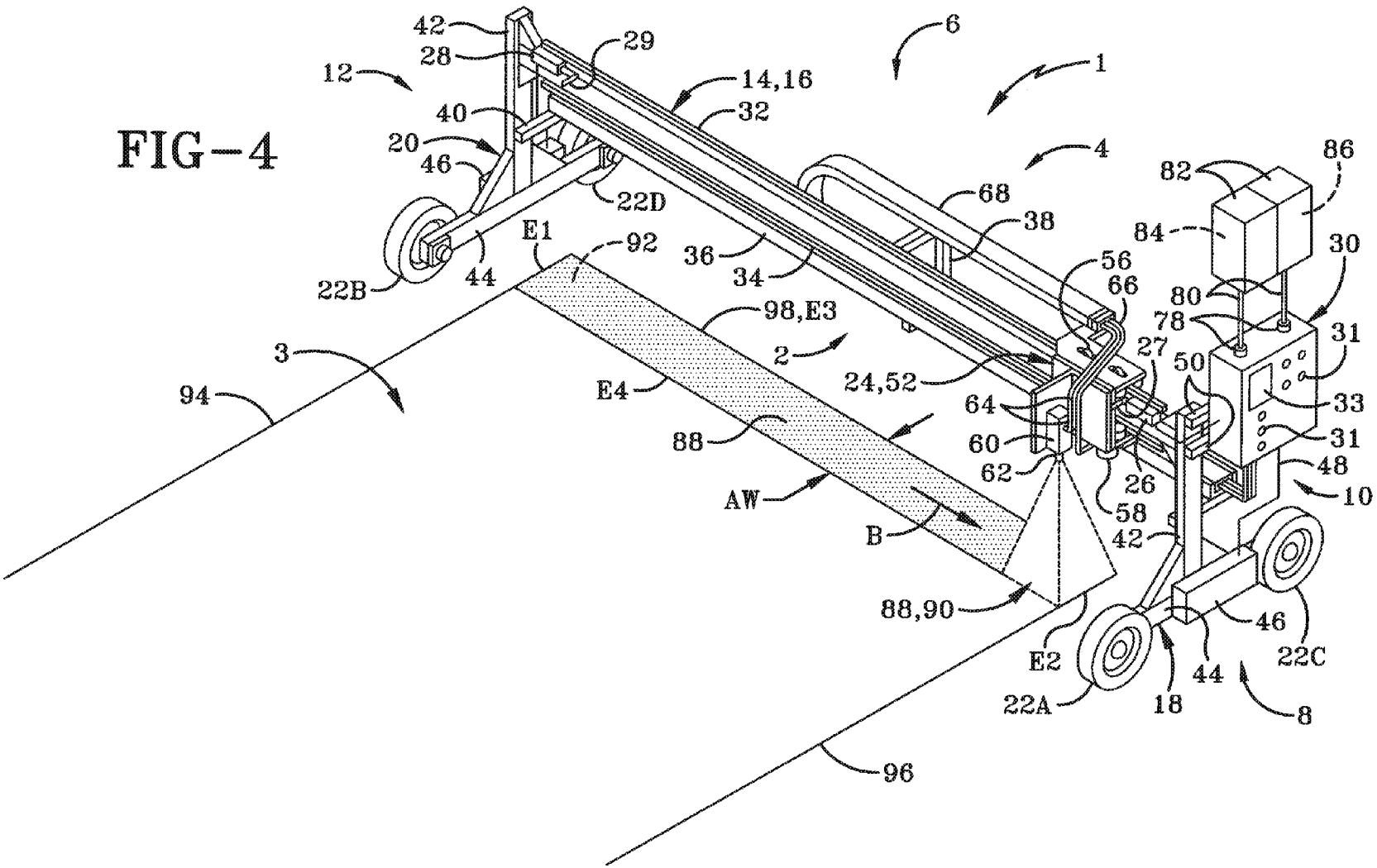
FIG. 4 is similar to FIG. 3 and shows the coating applicator at its leftmost position in the process of finishing the application of the first ribbon of coating material to the substrate.

FIG. 3 shows carriage 52 and applicator 60 having moved leftward (Arrow A) from the rightmost initial position of FIG. 2 to an intermediate position about midway between right side 94 and left side 96 of substrate 3 and about midway between the left and right sides of apparatus 1 whereby approximately half of a first band or ribbon L1 (FIG. 4) of coating material 88 has been applied to substrate 3. FIG. 4 shows carriage 52 and applicator 60 having moved further leftward (Arrow B) from the intermediate position of FIG. 3 to the leftmost position, thereby substantially completing formation of the first ribbon L1 of coating material 88 to substrate 3. During application of material 88 to form ribbon L1, carriage 52 and applicator 60 typically move right to left at a constant rate in a continuous fashion from adjacent right side 94 to adjacent left side 96 and simultaneously sprayer 60 sprays at a constant flow rate or spray rate to apply ribbon L1 of material 88 to substrate 3 at a constant or uniform thickness.

Ribbon L1 is substantially rectangular and extends continuously from right side 94 to left side 96 and is a right-to-left ribbon, having been applied from the right to the left. Ribbon L1 has a right axial edge or end E1 at right side 94, a left axial edge or end E2 at left side 96, an elongated straight longitudinal or lateral rear edge E3 extending from right side 94 to left side 96 at starting line 98, and an elongated straight front longitudinal or lateral edge E4 which extends from right side 94 to left side 96 parallel to and forward of rear edge E3. Frame 14 and wheels 22 remain entirely stationary during the right-to-left movement of carriage 52 and applicator 60 from the rightmost position of FIG. 2 to the leftmost position of FIG. 4 and the associated continuous spraying of material 88 during this movement. At this stage, ribbon L1 is nearly complete although the thickness of material 88 at left edge E2 is slightly less than the rest of ribbon L1. However, this thickness is subsequently increased to make the entire thickness of ribbon L1 uniform as described further below.

As coating applicator assembly 24 reaches its leftmost position (FIG. 4), carriage 52 of assembly 24 contacts and depresses or otherwise activates left arm or switch 27 of left sensor 26, thereby typically closing or opening an electrical circuit to send to the computer of control unit 30 a signal indicative of assembly 24 reaching the leftmost position. In response to this signal, the computer then controls motors 46 of the travel advancement mechanism to drive forward rotation of wheels 22 to move frame 14 along with applicator 60 forward (Arrow C in FIG. 5) along left side 96 while applicator 60 remains at or adjacent its leftmost position. The rate of this forward movement of apparatus 1 and thus applicator 60 is preferably the same as the immediately preceding rate of right-to-left travel of carriage 52 and applicator 60 from right side 94 to left side 96. Thus, applicator 60 continues to apply material 88 in the same continuous fashion and at the same flow rate while applicator 60 continues to move at a constant rate although in a different direction (forward) which is substantially perpendicular to the previous right-to-left direction. This constant rate of movement of applicator 60 and constant flow or spray rate thus applies coating material 88 evenly throughout the right-to-left movement and the forward movement to produce ribbon L1 with a uniform thickness throughout.

Also in response to the above-noted signal indicative of assembly 24 reaching the leftmost position, the computer of control device 30 controls carriage drive mechanism 58 to stop driving carriage 52 and applicator 60 in the right-to-left direction and immediately reverse its driving direction to drive carriage 52 and applicator 60 in a straight left-to-right direction parallel to the right-to-left direction. In the exemplary embodiment, there is thus essentially or almost no pause between the movement in the right-to-left direction and movement in the left-to-right direction. Thus, while the entire apparatus is moving forward (Arrow C in FIG. 5), carriage 52 and applicator 60 have already begun moving in the left-to-right direction so that the movement of applicator 60 during the forward movement of apparatus 1 is substantially but not exactly perpendicular to the left-to-right or right-to-left side-to-side or lateral movement of applicator 60. Inasmuch as the forward movement of apparatus 1 is a relatively short distance and occurs relatively quickly, applicator 60 remains adjacent left side 96 throughout this forward movement. The computer precisely controls the forward movement of apparatus 1 from the position of FIG. 4 to the position of FIG. 5 so that apparatus 1 and applicator 60 move forward an axial travel distance AD (FIG. 5) which is typically slightly less than an axial width AW (FIG. 4) of ribbon L1 and spray 90 as measured at substrate 3. The computer thus controls the travel advancement mechanism such as by simultaneously and at the same rate ramping up the voltage to motors 46 to cause forward synchronized rotation of wheels 22 and forward movement from the position of FIG. 4 to the position of FIG. 5 and then simultaneously and at the same rate ramping down the voltage to motors 46 to a synchronized stop to stop forward rotation of wheels 22 and the forward movement of vehicle 1 at the position of FIG. 5.

Figure 5:
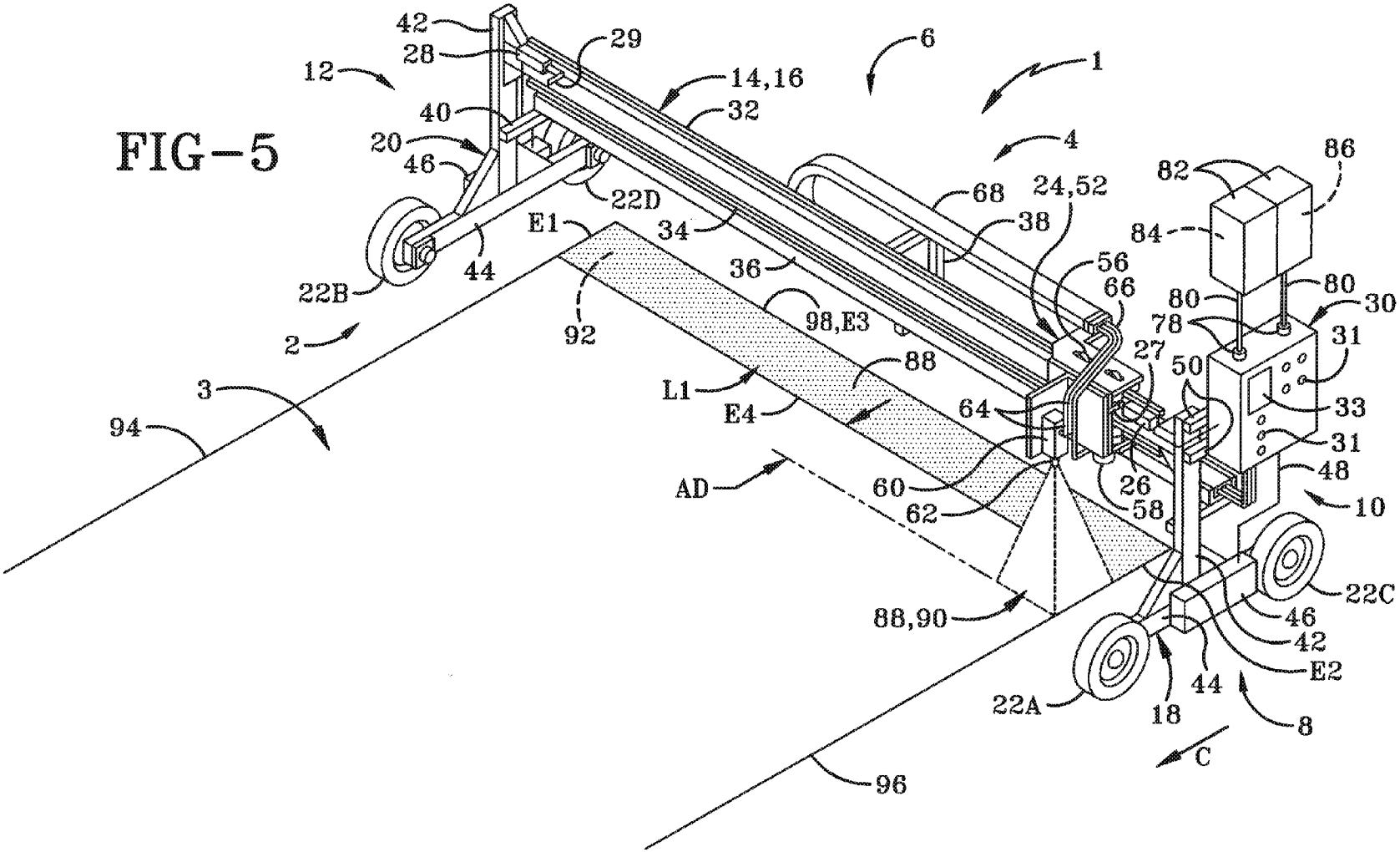
FIG. 5 is similar to FIG. 4 and shows a subsequent stage of application in which the travel advancement mechanism of the coating apparatus has moved the apparatus forward so that the applicator is applying a left end segment of the material to the substrate.
Figure 6:
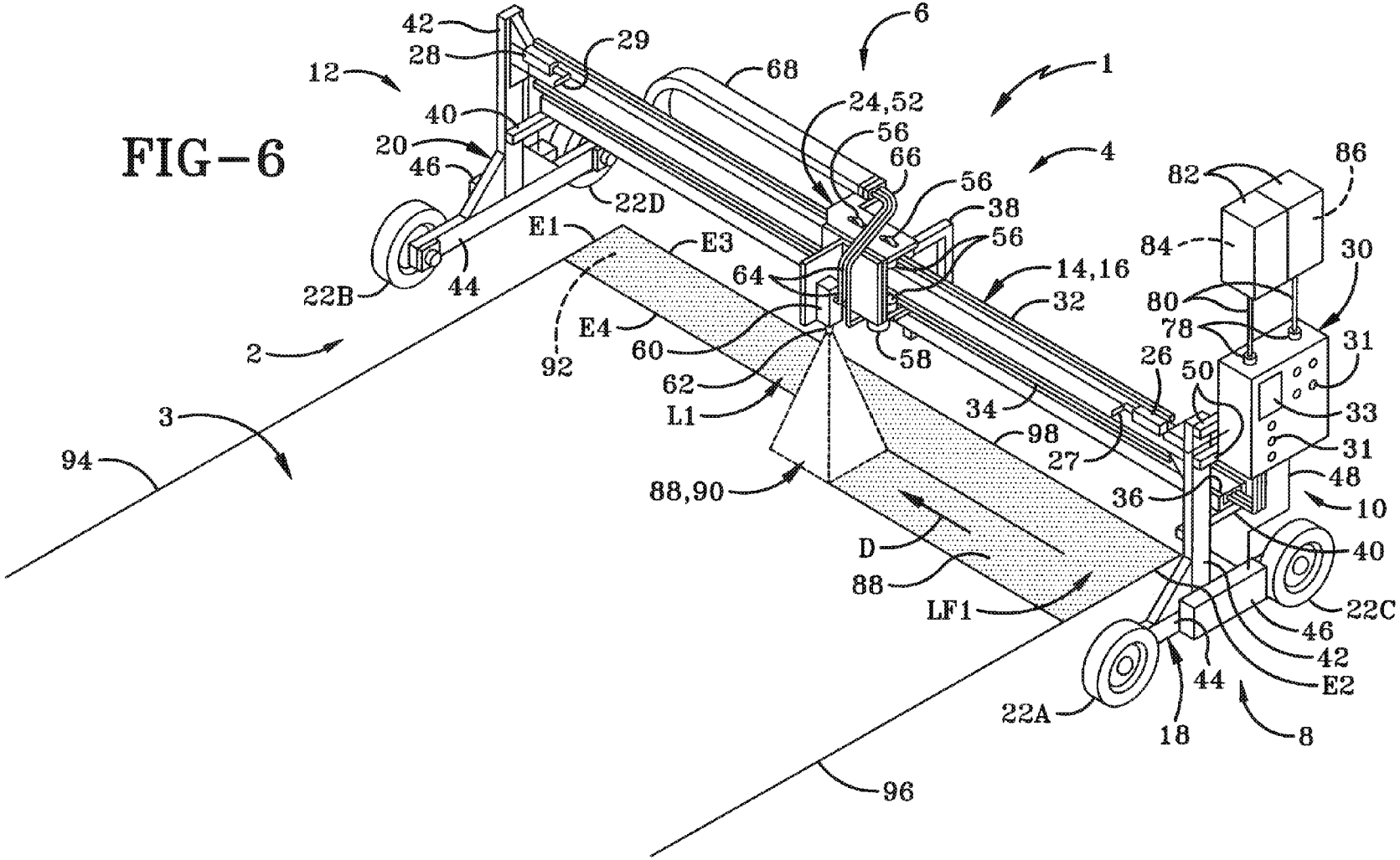
FIG. 6 is similar to FIG. 5 and shows a subsequent stage in which the coating applicator is moving from the left to the right while the coating apparatus remains stationary and shows the coating material about halfway finished in applying a ribbon of material as the applicator moves from the left to the right.
Figure 7:
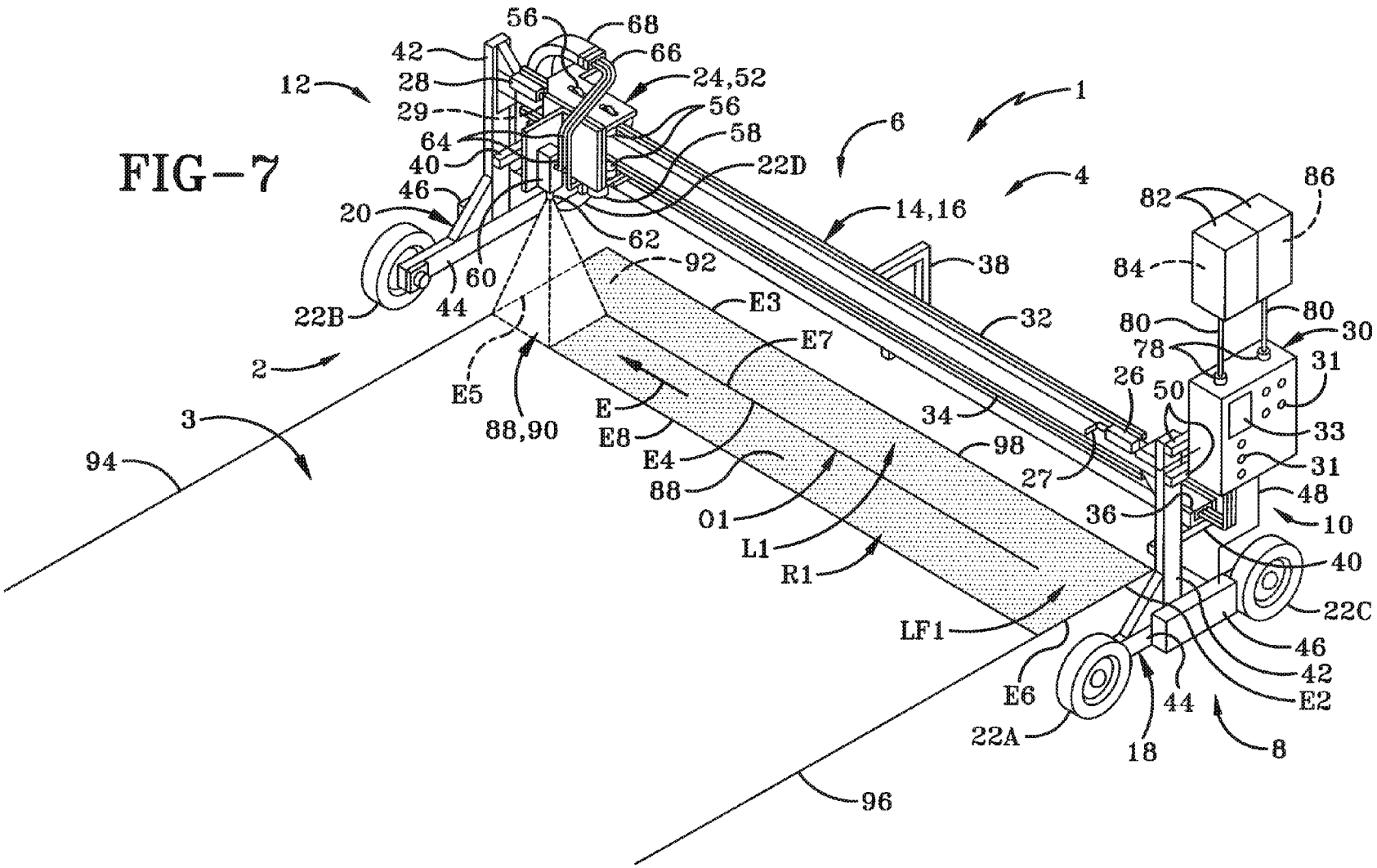
FIG. 7 is similar to FIG. 6 and shows a subsequent stage in which the coating applicator has reached the rightmost position so that the applicator is finishing the application of the material of the left-to-right ribbon so that this second ribbon of coating material applied to the substrate is forward of, parallel to and overlaps the first ribbon only to a very small degree.

At the stage of FIG. 5, the application of material 88 to form ribbon L1 is complete and the continued application of material 88 by applicator 60 during forward movement of apparatus 1 has formed a left end segment LF1 (FIG. 6) of material 88 on substrate 3 such that the first or rear half of segment LF1 adjacent starting line 98 also forms the upper portion of the left end of ribbon L1 and so that the front half of segment LF1 forms the lower portion of the left end of another ribbon R1 (FIG. 7). The front half of segment LF1 is thus the very beginning of the formation of ribbon R1.

As shown in FIG. 6, the computer controls the travel advancement mechanism so that frame 14 and wheels 22 remain stationary while simultaneously controlling carriage drive 58 to continue moving carriage 52 and applicator 60 from the left to the right (Arrow D) to continue applying material 88 to substrate 3 and thus continue forming left-to-right ribbon R1, which is shown about halfway finished. FIG. 7 shows that applicator 60 has continued its left-to-right movement (Arrow E) so that it has reached the rightmost position and thus finished its left-to-right movement so that ribbon R1 is nearly complete and parallel to ribbon L1. Ribbon R1 is substantially rectangular and extends continuously from right side 94 to left side 96. Ribbon R1 has a right axial edge or end E5 at right side 94, a left axial edge or end E6 at left side 96, an elongated straight rear longitudinal or lateral edge E7 extending from right side 94 to left side 96, and an elongated straight front longitudinal or lateral edge E8 which extends from right side 94 to left side 96 parallel to and forward of rear edges E3 and E7. Rear edge E7 typically slightly overlaps front lateral edge E4 of ribbon L1 at overlap O1 as a result of the slight difference between axial width AW (FIG. 4) and predetermined programmed axial travel distance AD (FIG. 5).

As coating applicator assembly 24 reaches its rightmost position (FIG. 7), carriage 52 of assembly 24 contacts and depresses or otherwise activates right arm or switch 29 of right sensor 28, thereby typically closing or opening an electrical circuit to send to the computer of control unit 30 a signal indicative of assembly 24 reaching the rightmost position. In response to this signal, the computer then controls motors 46 of the travel advancement mechanism (in the manner described above) to drive forward rotation of wheels 22 to quickly move frame 14 along with applicator 60 forward (Arrow F in FIG. 8) along right side 94 while applicator 60 remains at or adjacent its rightmost position. The rate of this forward movement of apparatus 1 and thus applicator 60 is preferably the same as the immediately preceding rate of left-to-right travel of carriage 52 and applicator 60, as well as rate of the earlier forward movement along left side 96 (FIG. 5) and the earlier right-to-left travel of carriage 52 and applicator 60 from right side 94 to left side 96 (FIGS. 3 and 4). Just as previously discussed, applicator 60 continues to apply material 88 in the same continuous fashion and at the same flow rate while applicator 60 continues to move at a constant rate although in a different direction (axial and forward) which is substantially perpendicular to the previous longitudinal or lateral travel directions. This constant rate of movement of applicator 60 and constant flow or spray rate thus applies coating material 88 evenly throughout the left-to-right movement and the forward movement along right side 94 to produce ribbon R1 with a uniform thickness throughout.

Figure 8:
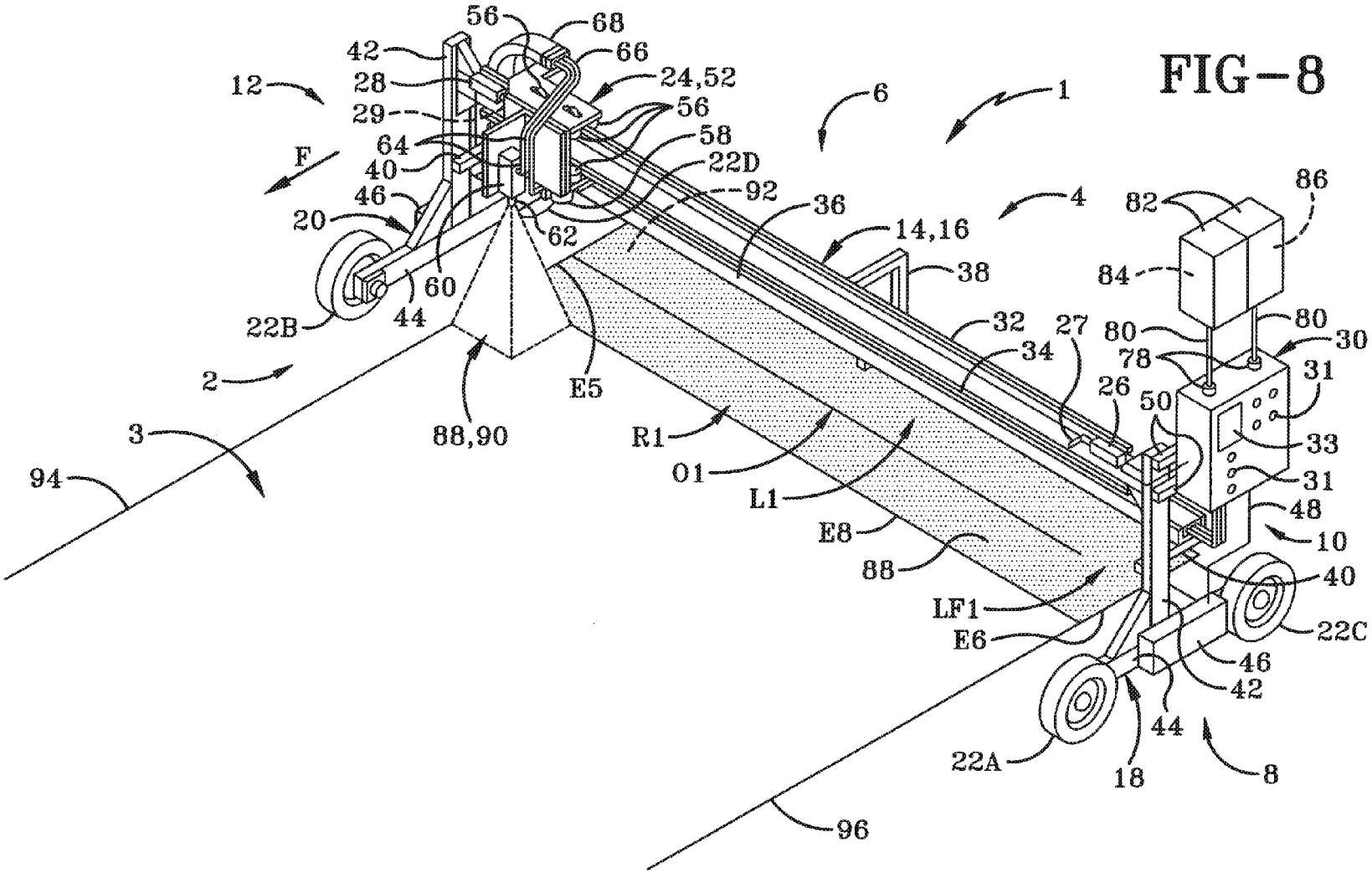
FIG. 8 is similar to FIG. 7 and shows the subsequent stage in which the travel advancement mechanism has moved the coating apparatus forward so that the applicator applies a right end segment of material to the substrate. Similar to FIG. 5, FIG. 8 also shows the position at which the forward movement of the coating apparatus has stopped at about the time that the coating applicator begins applying another ribbon of coating material to the substrate from the right to the left.

Also in response to the above-noted signal indicative of assembly 24 reaching the rightmost position, the computer of control device 30 controls carriage drive mechanism 58 to stop driving carriage 52 and applicator 60 in the left-to-right direction and immediately reverse its driving longitudinal or lateral direction to drive carriage 52 and applicator 60 in a straight right-to-left longitudinal direction (Arrow G in FIG. 9) parallel to the left-to-right direction used in applying ribbon R1. In the exemplary embodiment, there is thus essentially or almost no pause between the movement in the left-to-right direction to apply ribbon R1 and movement in the right-to-left direction shown in FIG. 9. Thus, while the entire apparatus is moving forward (Arrow F in FIG. 8) with applicator 60 adjacent right side 94, carriage 52 and applicator 60 have already begun moving in the right-to-left direction so that the movement of applicator 60 during the forward movement of apparatus 1 is substantially but not exactly perpendicular to the left-to-right or right-to-left side-to-side or lateral movement of applicator 60. Inasmuch as the forward movement of apparatus 1 in FIG. 8 is a relatively short distance and occurs relatively quickly, applicator 60 remains adjacent left side 96 throughout this forward movement. The computer precisely controls the forward movement of apparatus 1 from the position of FIG. 7 to the position of FIG. 8 so that apparatus 1 and applicator 60 move forward an axial travel distance AD (as shown earlier in FIG. 5) which is typically slightly less than an axial width AW (as shown earlier in FIG. 4) of ribbon R1 and spray 90 as measured at substrate 3. The computer thus controls the travel advancement mechanism such as by ramping up motors 46 (in the manner previously discussed) to cause the forward movement from the position of FIG. 7 to the position of FIG. 8 and then ramping down motors 46 to a stop to stop the forward movement at the position of FIG. 8.

Figure 9:
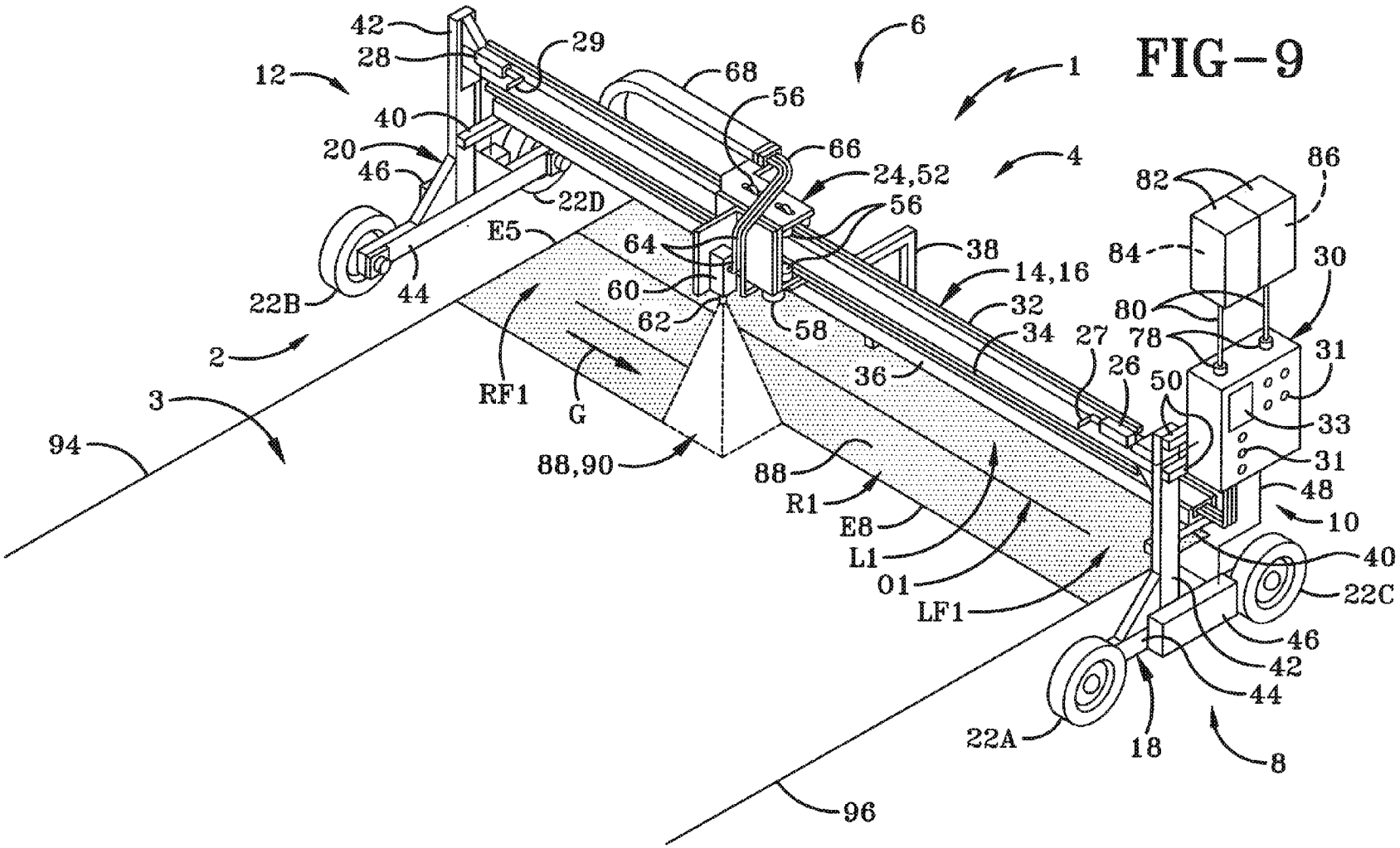
FIG. 9 is similar to FIG. 8 and shows a subsequent stage in which the coating applicator has moved from the right-most position of FIG. 8 to the left such that the coating applicator is about midway between the left and right sides of the apparatus whereby about half of a third ribbon of coating material has been applied to the substrate, again with a minor overlap between the second and third parallel ribbons.
Figure 10:
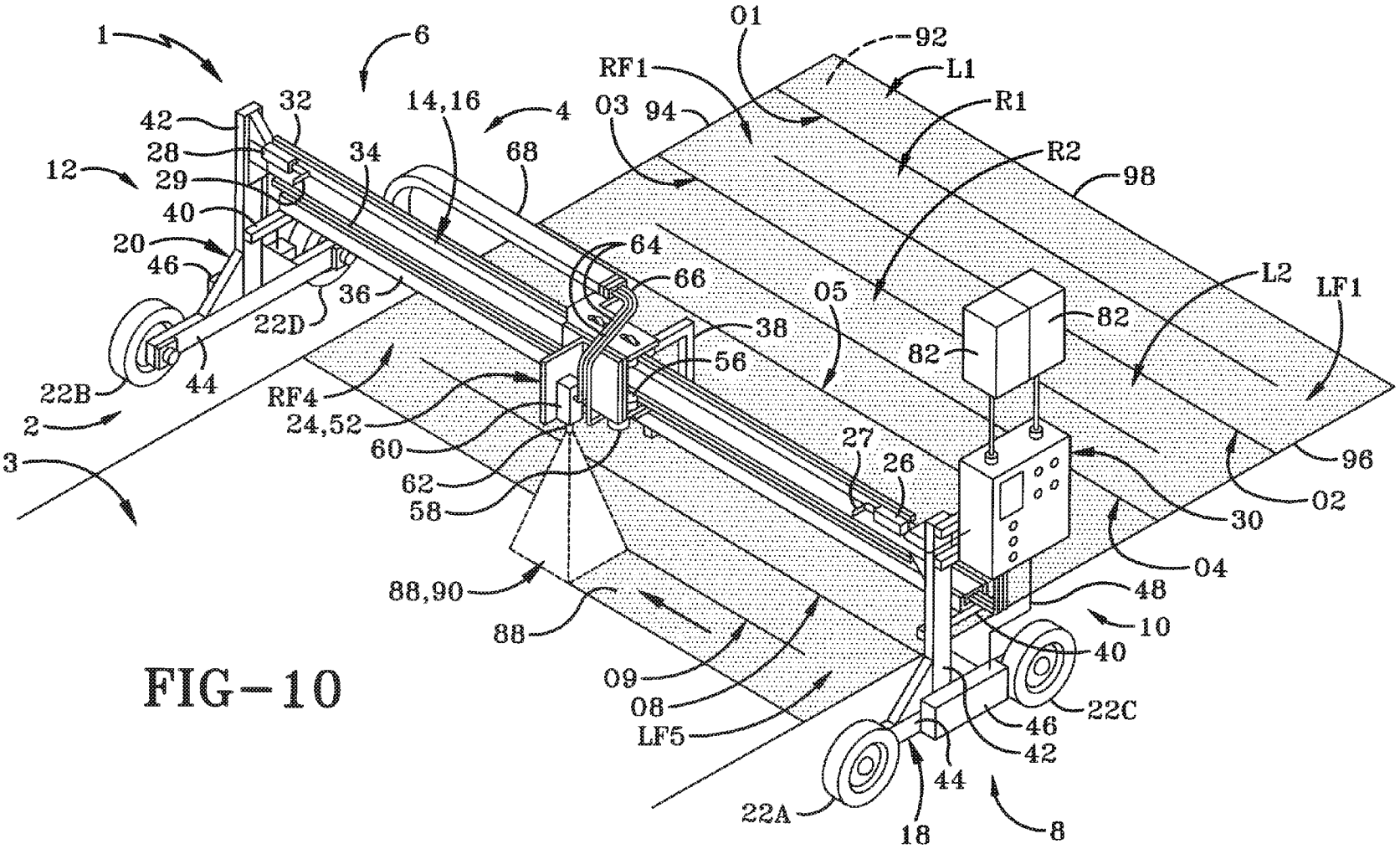
FIG. 10 is similar to the previous operational views at some time subsequent to the stage shown in FIG. 9 such that the coating apparatus has intermittently advanced forward seven times relative to the position shown in FIG. 9 in order to apply six additional full parallel ribbons of the coating material to the substrate along with the associated end segments, and is about midway in applying an additional ribbon of material.

At the stage of FIG. 8, the application of material 88 to form ribbon R1 is complete and the continued application of material 88 by applicator 60 during forward movement of apparatus 1 has formed a right end segment RF1 (FIG. 9) of material 88 on substrate 3 such that the first or rear half of segment RF1 also forms the upper portion of the right end of ribbon R1 and the front half of segment RF1 forms the lower portion of the right end of another ribbon L2 (FIG. 10). The front half of segment RF1 is thus the very beginning of the formation of right-to-left ribbon L2. FIG. 8 also shows the position at which the forward movement of apparatus 1 has stopped as applicator 60 is beginning right-to-left movement to continue applying ribbon L2.

FIG. 8 is analogous to FIG. 2 and illustrates the completion of a full cycle of movement of coating apparatus 1 and coating applicator 60 relative to the position shown in FIG. 2 whereby apparatus 1 has applied the first right-to-left longitudinal or lateral ribbon L1, the first left end axial segment LF1, the first left-to-right ribbon R1 (which serves as a second ribbon forward of and parallel to ribbon L1) and the first right end axial segment RF1. FIG. 8 also shows the beginning of the next full cycle of the application of material 88 to substrate 3. FIG. 9 is analogous to FIG. 3 and shows the coating application cycle repeating itself in the same manner as described previously. FIG. 9 also shows applicator 60 about midway between the left and right sides of apparatus 1 whereby about half of the third ribbon L2 has been formed.

Figure 11:
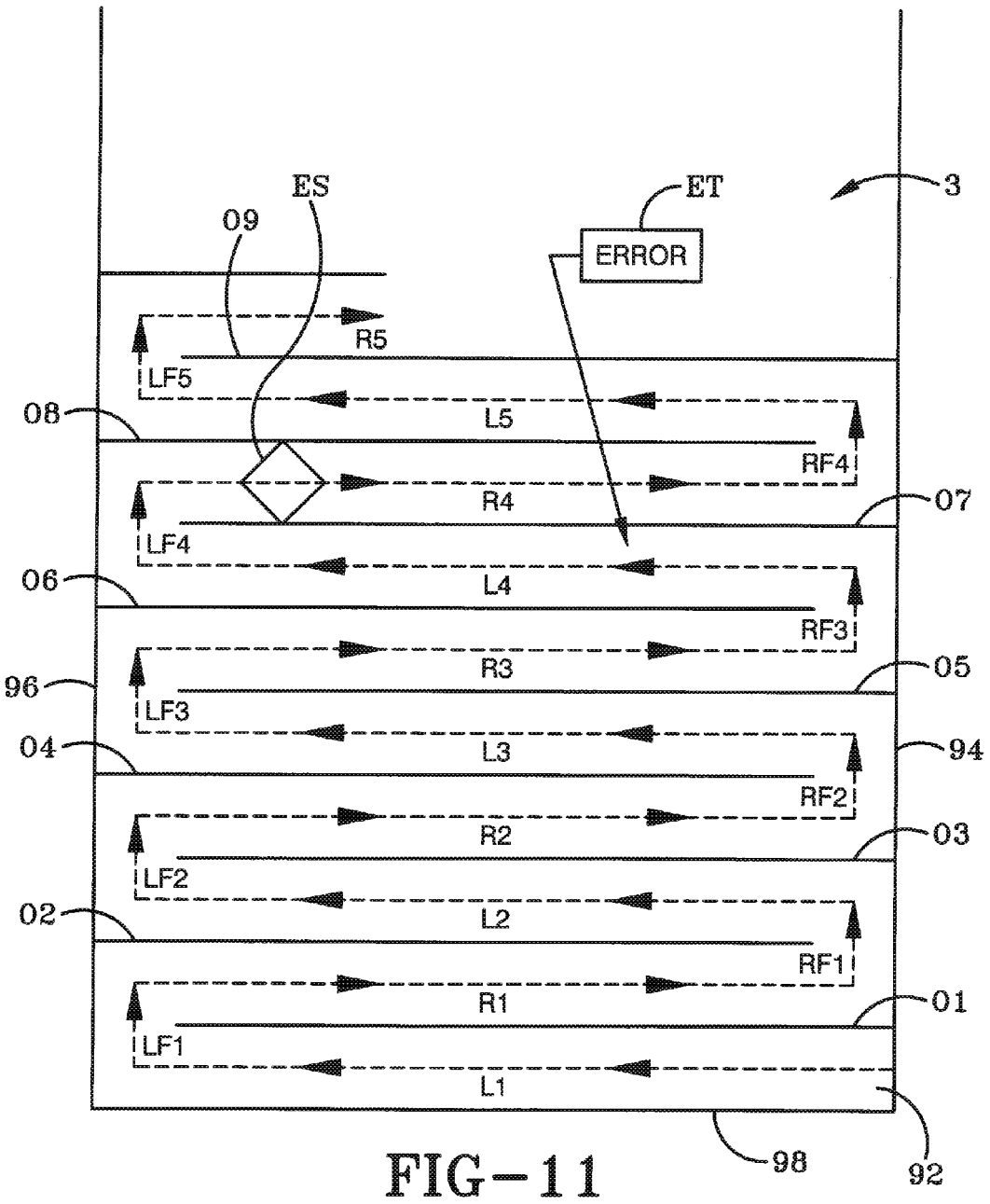
FIG. 11 is a diagrammatic view showing the application pattern of the coating material and the directions that the coating applicator moves during application to the substrate.

FIGS. 10 and 11 show the coating application cycle having been repeated beyond the first full cycle for three full additional cycles and about another ¾ cycle to form a total of 9½ ribbons including right-to-left ribbons L1, L2, L3, L4 and L5 and left-to-right ribbons R1, R2, R3, R4 and half of ribbon R5, as well as four right end segments RF1, RF2, RF3 and RF4, and five left end segments LF1, LF2, LF3, LF4 and LF5. FIGS. 9 and 10 illustrate the same type of overlaps previously discussed between each adjacent right-to-left ribbon and left-to-right ribbon, these overlaps all being substantially equal in degree and shown particularly at O1 between ribbons L1 and R1, at O2 between ribbons R1 and L2, at O3 between ribbons L2 and R2, at O4 between ribbons R2 and L3, at O5 between ribbons L3 and R3, at O6 between ribbons R3 and L4, at O7 between ribbons L4 and R4, at O8 between ribbons R4 and L5, and at O9 between ribbons L5 and R5.

FIG. 11 illustrates both the application pattern of coating material 88 and the direction of movement of applicator 60 during application to the substrate. More particularly, the dashed line with arrows shows the path along which applicator 60 travels during the application of material 88 to substrate 3 to form the ribbons and end segments previously discussed. Applicator 60 thus begins at the initial position 92 and moves along a straight right-to-left path illustrated by Arrow L1 from right side 94 to left side 96, then along a forward lateral path LF1 adjacent left side 96 the predetermined distance AD (FIG. 5) as apparatus 1 moves forward, then along a left-to-right path R1 which is straight, forward of and parallel to path L1 and begins at the front of path LF1 adjacent left side 96 and ends at right side 94 forward of and adjacent initial position 92. Applicator 60 then moves forward along axial path RF1 the predetermined distance AD (FIG. 5) adjacent right side 94 as the coating apparatus moves forward, thereby completing a full cycle and beginning again with a right-to-left path L2 which is parallel to and forward of path R1 and extends from right side 94 to the left side 96. Thus applicator 60 continues along the path shown by the dashed lines in FIG. 11 to produce the coating pattern previously described.

In the exemplary embodiment, the computer program controls the operation of apparatus 1 so that apparatus 1 intermittently moves forward and stops such that during these forward movements, applicator 60 alternately is spraying material 88 along the sides of substrate 3, and so that when the frame and wheels are stationary during the intermittent stops, applicator 60 alternately moves in one or the other lateral direction while spraying material 88. In the exemplary embodiment, once sprayer 60 has begun spraying material 88 at initial position 92, sprayer 60 continuously sprays material 88 throughout the entire process until the job is completed or until spraying must stop as a result running out of material to spray or the need for an additional supply such as new or refilled containers 82. The spraying process is controlled in a manner which ensures that the coating material 88 which is sprayed onto substrate 3 has a uniform thickness over the entire area of substrate 3 which is coated other than relatively minor variations at the various overlaps O1-O9. As previously noted, each of these overlaps is relatively narrow and in some cases may be substantially nonexistent depending on the specific circumstances. In the exemplary embodiment, material 88 is sprayed at a constant flow rate or spray rate while the longitudinal and axial movements are also performed at a constant rate in order to provide this uniform thickness or depth of coating 88 on substrate 3. Thus, each of the ribbons and end segments of coating 88 on substrate 3 are of the same or essentially the same thickness or depth throughout their entirety.

Figure 12:
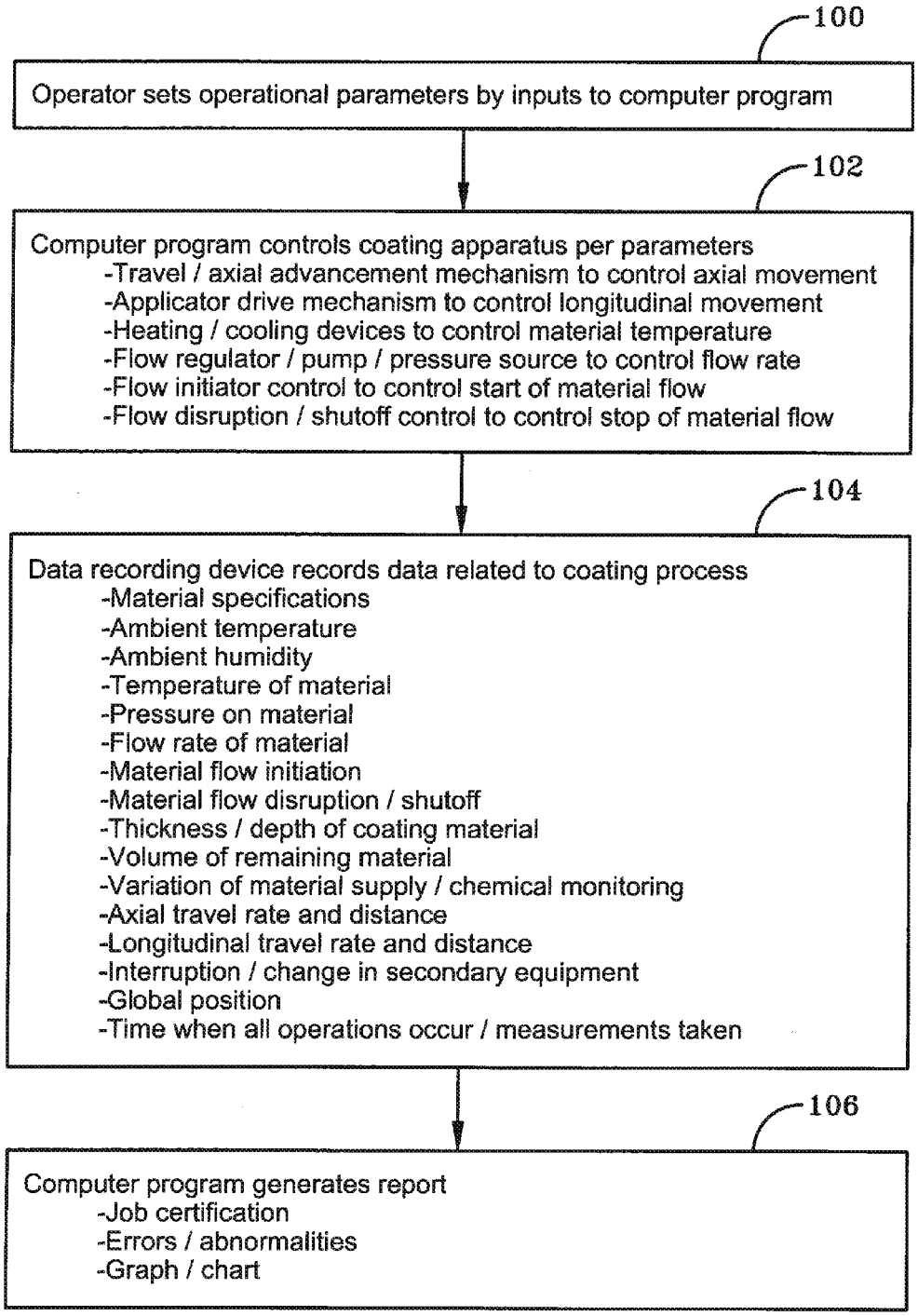
FIG. 12 is a flow chart related to the operation of the coating apparatus of the present invention.

The flow chart of FIG. 12 illustrates the overall operation of apparatus 1. As generally noted before and as shown at Block 100, the operator sets the operational parameters of the coating apparatus by inputting the desired parameter setting information into the computer to create an operator-input job-specific computer program, which is used to control the coating apparatus in accordance with the parameters as shown in Block 102. In accordance with these parameters, the computer program thus controls the various aspects of the coating apparatus further listed in Block 102. For example, the computer program controls the travel or axial advancement mechanism to control axial movement of apparatus 1 in the manner previously discussed in greater detail. The computer program further controls the applicator drive mechanism to control longitudinal movement of the carriage and applicator in the longitudinal or lateral direction as described in greater detail further above. The computer program also controls heating and cooling devices to control material temperature, which may include the temperature of materials 84, 86 and 88. As previously noted, such heating and cooling devices may include those which are located adjacent containers 82, along the feed lines from the containers to the applicator, and adjacent the applicator as well. These heating and cooling devices operate in conjunction with the temperature sensors which are used to sense the temperature of the materials in containers 82, within feed lines 80 and 64 and/or within or adjacent applicator 60. The heating and cooling devices are thus typically operated to either heat or cool the various materials noted above in response to the feedback signals from one or more of these temperature sensors. The computer program further controls the flow rate of materials 84, 86 and 88 via the flow regulator, pump and/or pressure source previously discussed. The computer program also controls the start of the material flow within lines 80 and 64 and thus the discharge of material 88 from applicator 60 by opening or turning on the flow initiator control. Similarly, the computer program controls the stopping of the material flow by controlling the flow disruption or shutoff control.

With respect to temperature control of the temperature of materials 84, 86 and 88 at or adjacent applicator 60, the temperature sensor adjacent applicator 60 senses the temperature of mixture 88 adjacent and typically within applicator 60 or the temperature of first and second materials 84 and 86 adjacent and typically just prior to entering applicator 60. A signal or signals corresponding to the temperature of mixture 88 adjacent applicator 60 or temperatures of materials 84 and 86 are sent to the computer of control unit 30, which determines in an ongoing manner whether the temperature(s) is or are within a desired range. If so, control unit 30 maintains heating element 74 in its current state to maintain the temperature(s) within the desired range. If the temperature(s) is or are too low, controller 30 controls the electrical current to one or more of heating elements 74 to increase the temperature(s) to within the desired range. If the temperature(s) is or are too high, controller 30 controls the electrical current to one or more of heating elements 74 to decrease the temperature(s) to within the desired range.

One of the key aspects of the present invention is the ability to record and analyze data for the purpose of certifying a given coating application to an end user and/or determine when and where any problems occurred during the coating process so that any such problems may be corrected. This recorded data related to the coating process is indicated broadly at Block 104 in FIG. 12. The data recorded may include any or all of the items listed further in Block 104. This may include the material specifications of material 84, 86 and 88. For instance, the operator may input this data into the computer program via one of the operator input devices, which can include a keyboard for typing information in, a scanner for scanning a label having a material specification encoded thereon or the like. The data may also include the ambient temperature as measured by the corresponding temperature sensor, the ambient humidity as measured by the humidity sensor, the temperature of materials 84, 86 and 88 based on temperatures sensed by the various temperature sensors previously discussed, the pressure on these various materials as sensed by the pressure gauge or gauges previously discussed, and the flow rate of these materials as typically sensed by the flow meter previously discussed. This recorded data may also include material flow initiation, which is the start or beginning of the flow or application of material 84, 86 and 88 which begins at the initial starting point 92 or at any other place at which the flow is initiated after having been shut off. This data also may include material flow disruption or shutoff, which may be an inadvertent or intentional disruption or shutoff of the flow of all of these materials. The recorded data may also include the thickness or depth of coating material 88 applied to substrate 3, which may be calculated by the computer program or measured by a depth sensor. The volume of remaining material within containers 82 may also be recorded. The variation of material supply and chemical monitoring may also be among the recorded data. This may relate to the refilling of one or both containers 82 or the removal and replacement of one or both of containers 82 with like containers including an additional supply of materials 84 and 86. This may also relate to the use of chemical monitoring equipment which monitors one or more chemicals within materials 84 and 86 especially with regard to any variations thereof during the application process. The recorded data may also include the axial travel rate and distance of apparatus 1 created by the travel or axial advancement mechanism, along with the longitudinal travel rate and distance of the applicator created by the applicator drive mechanism. This recorded data may also include the interruption or change in any of the secondary equipment used with coating apparatus 1. The latter may include the changing of the containers 82 as noted above, but may also include any other interruptions or changes in the secondary equipment whether inadvertent or intentional. Thus, such secondary equipment is in electrical or other communication with the computer program and data recording device to allow this recording to take place. The global position of coating apparatus 1 may also be recorded using the global positioning receiver. Further, the timer or clock is used to record when all of these various operations occur and/or when the various measurements are taken. Thus, the timer provides a real time snapshot of when all of the other data listed in Block 104 occurs. Thus, for instance, the timer allows the recorded data to include the date and time when a given ambient temperature measurement or humidity measurement is taken whereby the recorded data is able to provide substantially continuous tracking of such temperature and humidity over the entire course of the operation of the coating apparatus during a given coating job. Likewise, the timer allows for providing the date, time and duration of various other operations or measurements, and thus likewise provide substantially continuous tracking thereof.

As shown at Block 106 in FIG. 12, the computer program will then generate a report which includes all of the recorded data from the entire coating job, although a report may also be generated at an earlier time during the process of applying the coating. As previously discussed, the operator or end user may use the recorded data in order to assess when and where any problems or abnormalities occurred during the coating process. In addition, the recorded data may be used to certify that a job has met the desired specifications. The recorded data may be recalled and displayed in various forms, including on the onboard screen 33 (FIG. 1) or at a remote location. For example, the recorded data may be downloaded from the computer of apparatus 1, for instance using a flash drive or any other suitable recording medium, then taken to a remote location to upload the recorded data from the recording medium onto a separate computer and/or printer in order to print the recorded data out for review or to display it on a separate screen or the like. Alternately, the recorded data may be transferred wirelessly from the onboard computer to another computer if desired. The display on any given screen or the printed data may include graphs representing the various information that was recorded. For example, a graph may be created which shows the overall movement of the applicator 60 and the consequent ribbons or segments of material 88 laid on substrate 3, and may include text or various types of symbols to show where a potential application error took place or to show any other aspects of the recorded information, such as showing at any given time what the ambient temperature or humidity or the various conditions under which the coating material was applied. For example, FIG. 11 may serve as such a graph, and shows an error symbol ES and an error text ET each of which shows a simple manner of highlighting a coating application error. The error symbol ES in FIG. 11 is shown as a diamond-shaped figure, but may be of any shape and additionally may be of a color which is different than that of the other text and symbols on the graph in order to be easily discerned visually. Similarly, the error text ET in the example simply uses the word "error" and may also be of a different color. Each of error symbol ES and error text ET make an association as to where the error occurred. For example, the error symbol ES is located on ribbon R4 about ¼ to ⅓ of the way from the left side to the right side of substrate 3. Thus, the computer program creates a graph or other report which indicates with specificity the location of where the error occurs whereby the end user or other reviewer of the report may locate the actual place of the error at the jobsite. The use of the error text ET in FIG. 11 is slightly different in that the text itself is not shown at the location where the error occurred. Instead, an arrow is used from the error text to show the location of the error. In addition to the location of the error, the report provides the date and time at which it occurred. The global positioning system may be used to pinpoint the location of any errors. Alternately, if a GPS is not used, the location of the error may be established, for instance, by providing the location of initial position 92 relative to a known landmark or the like and then calculated by computer based on the recorded movements of the applicator.

As previously discussed, the exemplary embodiment illustrates a setup in which two materials 84 and 86 are fed through the feed lines to a mixing chamber of the applicator and subsequently discharged as a mixed material 88 onto substrate 3 although the coating apparatus may be configured for a single material coming from the material supply through the feed lines and directed to the coating applicator. One example of a two-component material which is pumped or forced from the two containers 82 to be mixed and sprayed by applicator 60 is polyurea. There are numerous chemical formulas for various conditions, such as formulas which include pre-polymer blends and isocyanate blends. Amongst the thousands of possible applications are bed liners, concrete or steel bridges such as for waterproofing and harsh conditions, waste treatment plants over clarifiers, digesters, tanks and so forth, additional coatings that may be applied to, for instance, structural steel, mining machinery, farm machinery, metal roof coating, over polyurethane foam or other materials for ultraviolet protection and so forth.

Although apparatus 1 is shown configured for applying a coating to a substantially horizontal substrate, it is within the present inventive concept to apply coatings to various types of surfaces, including vertical surfaces, curved surfaces and so forth. Thus, the coating apparatus may be modified to apply coatings to building walls, ceilings, the tops and sides of storage tanks, ships, pipes and many other objects. Apparatus 1 in the exemplary embodiment is also illustrated as including a travel advancement mechanism which is mounted on the frame of the apparatus in order to move the frame relative to the substrate. However, it is also within the inventive concept to provide an axial advancement mechanism which moves a given substrate axially relative to the frame instead of vice versa while still providing the lateral or longitudinal movement of the applicator along the frame. Thus, a substrate such as a generally flat object or a curved object such as a pipe may be moved axially relative to the frame of the apparatus in an intermittent fashion in the same manner as discussed above with respect to moving the frame relative to the substrate. In this aspect of the invention, the substrate is thus advanced a given distance at a given rate while the applicator is spraying continuously, and then the substrate stops and remains stationary while the applicator travels longitudinally to continue spraying from one side to the other, at which time the substrate is again advanced a predetermined distance and then stopped to remain stationary while the applicator moves in the opposite longitudinal direction. Thus, the spraying pattern on the substrate still produces parallel ribbons and the corresponding end segments perpendicular thereto, such as shown in FIGS. 10 and 11, or to produce an analogous pattern.

While the coating apparatus in the exemplary embodiment also utilizes a computer which may be programmed by the operator to set the parameters and then to control the apparatus in accordance with those parameters, it is also within the concept of the present invention to provide alternate controls that do not include this programmable feature whereby the coating apparatus operates mechanically using various control devices and sensors, such as adjustable magnetic proximity sensors, laser measuring devices, counters, optical sensors, readers and other measuring devices for determining the length of the ribbons of coating material, and speed controls for controlling the axial movement of the frame and/or substrate, and the lateral or longitudinal travel length of the applicator. Rheostat controllers may be used to engage such a multi-drive system to provide independent motor operation and movement, and can be configured to allow for ramping up and down of voltage to cause faster or slower speeds as needed for continuous movement of the applicator and continuous spraying in the same manner as described in the exemplary embodiment. Various features may also be used to cause the axial and longitudinal movement to start or stop, as well as causing the initiation and the stopping of the application of coating material from the applicator.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A method comprising the steps of:

creating relative axial movement between a freestanding self-propelled coating apparatus frame and a horizontal substrate;

driving a sprayer longitudinally back and forth along the frame;

spraying a coating material onto the substrate with the sprayer so that the coating material applied to the substrate includes:

a first ribbon which extends continuously from a left side of the substrate to a right side of the substrate and which has an elongated front edge;

a second ribbon which extends continuously from the left side of the substrate to the right side of the substrate, which has an elongated front edge and which has an elongated rear edge which overlaps the front edge of the first ribbon at a first elongated overlap; and a third ribbon which extends continuously from the left side of the substrate to the right side of the substrate, which has an elongated front edge and which has an elongated rear edge which overlaps the front edge of the second ribbon at a second elongated overlap; and further comprising the steps of:

moving the frame and sprayer forward, by a control device including a computer controlling operation of a travel advancement mechanism carried by the frame, while the sprayer is adjacent the left side of the substrate and while the sprayer is spraying the coating material onto the substrate so that the coating material applied to the substrate includes a left end segment which connects the first ribbon to the second ribbon along the left side of the substrate and which is substantially perpendicular to the first, second and third ribbons;

moving the frame and sprayer forward, by the control device controlling operation of the travel advancement mechanism carried by the frame, while the sprayer is adjacent the right side of the substrate and while the sprayer is spraying the coating material onto the substrate so that the coating material applied to the substrate includes a right end segment which connects the second ribbon to the third ribbon along the right side of the substrate and which is substantially perpendicular to the first, second and third ribbons;

wherein the sprayer sprays continuously throughout the step of spraying and the steps of moving;

recording with a recording device data concerning application of the coating material, thereby producing recorded data;

generating with a computer program a report which includes the recorded data; and based on the recorded data of the report, certifying to an end user a coating job performed by the apparatus when the coating job meets desired specifications including that the coating material applied to the substrate has a uniform thickness throughout its entirety other than any variations at the first and second overlaps.

2. The method of claim 1 wherein the step of spraying results in the coating material applied to the substrate including a fourth ribbon which extends continuously from the left side of the substrate to the right side of the substrate, which has an elongated front edge and which has an elongated rear edge which overlaps the front edge of the third ribbon at a third elongated overlap; and the step of certifying comprises certifying the coating job when the coating material applied to the substrate has a uniform thickness throughout its entirety other than any variations at the first, second and third overlaps.

3. The method of claim 2 wherein the step of spraying results in the coating material applied to the substrate including a fifth ribbon which extends continuously from the left side of the substrate to the right side of the substrate, which has an elongated front edge and which has an elongated rear edge which overlaps the front edge of the fourth ribbon at a fourth elongated overlap; and the step of certifying comprises certifying the coating job when the coating material applied to the substrate has a uniform thickness throughout its entirety other than any variations at the first, second, third and fourth overlaps.

4. The method of claim 1 wherein the step of driving comprises the step of driving the sprayer longitudinally back and forth along the frame from adjacent a left side of the frame to adjacent a right side of the frame during the step of spraying so that each of the first, second and third ribbons extends continuously from adjacent the left side of the frame to adjacent the right side of the frame.

5. The method of claim 1 wherein the recorded data includes a forward travel rate of the frame and sprayer, a forward travel distance of the frame and sprayer, a longitudinal travel rate of the sprayer, a longitudinal travel distance of the sprayer, ambient temperature, ambient humidity, a temperature of a liquid material in a supply container from which the liquid material flows to the sprayer, a pressure on the liquid material in the supply container, a volume remaining of the liquid material in the supply container, a flow rate of the liquid material to the sprayer, a flow initiation of flow of the liquid material from the supply container to the sprayer, a flow disruption of flow of the liquid material from the supply container to the sprayer, and one of a temperature of the liquid material in the supply container and a temperature of the liquid material adjacent the sprayer.

6. The method of claim 1 wherein the substrate is a bridge.

7. The method of claim 6 wherein the coating provides waterproofing to the bridge.

8. The method of claim 1 wherein each of the ribbons is substantially rectangular.

9. The method of claim 1 wherein the first, second and third ribbons are parallel.

10. The method of claim 1 further comprising one of the steps of calculating with the computer program the uniform thickness and measuring the uniform thickness with a depth sensor.

11. The method of claim 1 further comprising the step of using a programmable computer program to create an operator-input job-specific computer program including control parameters to control:

starting, stopping, duration and rate of forward travel of the frame and sprayer;

starting, stopping, duration and rate of longitudinal travel of the sprayer;

a flow rate of a liquid material from a supply container to the sprayer; and at least one of (a) a temperature range of the liquid material within the supply container, and (b) a temperature range of the liquid material within a feed line from the supply container to the sprayer.

12. The method of claim 1 wherein the sprayer moves longitudinally back and forth at a constant rate to produce the first, second and third ribbons; and the frame and sprayer move forward at the constant rate during the steps of moving.

13. The method of claim 1 further comprising the step of driving with at least one drive motor rotation of a plurality of wheels mounted on the frame to cause forward movement of the frame and sprayer.

14. The method of claim 13 further comprising the step of controlling operation of the at least one drive motor with the control device to start the rotation of the wheels, control a rate and duration of the rotation of the wheels, and stop rotation of the wheels.

15. The method of claim 14 wherein the plurality of wheels includes a left wheel and a right wheel;

the at least one motor includes left and right motors operatively connected respectively to the left and right wheels to respectively drive rotation thereof;

while at a first position, the frame is stationary relative to the substrate throughout the spraying the coating material onto the substrate to form the first ribbon;

while at a second position, the frame is stationary relative to the substrate throughout the spraying the coating material onto the substrate to form the second ribbon; and the step of controlling comprises simultaneously and at a same rate ramping up voltage to the left and right motors to cause forward synchronized rotation of the left and right wheels and forward movement of the frame from the first position to the second position, and then simultaneously and at a same rate ramping down voltage to the left and right motors to a synchronized stop to stop forward rotation of the left and right wheels and stop forward movement of the frame at the second position.

16. The method of claim 1 further comprising the step of feeding a first liquid material from a first supply container to the sprayer and a second liquid material from a second supply container to the sprayer so that the step of spraying comprises spraying a mixed material.

17. The method of claim 16 wherein the first liquid material is a resin and the second liquid material is a hardener which accelerates the hardening of the coating material on the substrate.

18. The method of claim 1 wherein the coating material is polyurea.

19. The method of claim 15 wherein while at a third position, the frame is stationary relative to the substrate throughout the spraying the coating material onto the substrate to form the third ribbon; and the step of controlling comprises simultaneously and at a same rate ramping up voltage to the left and right motors to cause forward synchronized rotation of the left and right wheels and forward movement of the frame from the second position to the third position, and then simultaneously and at a same rate ramping down voltage to the left and right motors to a synchronized stop to stop forward rotation of the left and right wheels and stop forward movement of the frame at the third position.

20. The method of claim 1 further comprising moving the frame and sprayer rearward by the control device controlling operation of the travel advancement mechanism carried by the frame to make corrections based on the recorded data of the report indicating that the desired specifications of the coating have not been met.

21. A method comprising the steps of:

creating relative axial movement between a freestanding self-propelled coating apparatus frame and a horizontal substrate;

driving a sprayer longitudinally back and forth along the frame;

spraying a coating material onto the substrate with the sprayer so that the coating material applied to the substrate includes:

a first ribbon which extends continuously from a left side of the substrate to a right side of the substrate and which has an elongated front edge;

a second ribbon which extends continuously from the left side of the substrate to the right side of the substrate, which has an elongated front edge and which has an elongated rear edge which overlaps the front edge of the first ribbon at a first elongated overlap; and a third ribbon which extends continuously from the left side of the substrate to the right side of the substrate, which has an elongated front edge and which has an elongated rear edge which overlaps the front edge of the second ribbon at a second elongated overlap; and further comprising the steps of:

moving the frame and sprayer forward in response to the sprayer activating a left sensor carried by the frame while the sprayer is adjacent the left side of the substrate and while the sprayer is spraying the coating material onto the substrate so that the coating material applied to the substrate includes a left end segment which connects the first ribbon to the second ribbon along the left side of the substrate and which is substantially perpendicular to the first, second and third ribbons;

moving the frame and sprayer forward in response to the sprayer activating a right sensor carried by the frame while the sprayer is adjacent the right side of the substrate and while the sprayer is spraying the coating material onto the substrate so that the coating material applied to the substrate includes a right end segment which connects the second ribbon to the third ribbon along the right side of the substrate and which is substantially perpendicular to the first, second and third ribbons;

wherein the sprayer sprays continuously throughout the step of spraying and the steps of moving;

recording with a recording device data concerning application of the coating material, thereby producing recorded data;

generating with a computer program a report which includes the recorded data; and based on the recorded data of the report, certifying to an end user a coating job performed by the apparatus when the coating job meets desired specifications including that the coating material applied to the substrate has a uniform thickness throughout its entirety other than any variations at the first and second overlaps.

22. A method comprising the steps of:

creating relative axial movement between a freestanding self-propelled coating apparatus frame and a horizontal substrate;

driving a sprayer longitudinally back and forth along the frame;

spraying a coating material onto the substrate with the sprayer so that the coating material applied to the substrate includes:

a first ribbon which extends continuously from a left side of the substrate to a right side of the substrate and which has an elongated front edge;

a second ribbon which extends continuously from the left side of the substrate to the right side of the substrate, which has an elongated front edge and which has an elongated rear edge which overlaps the front edge of the first ribbon at a first elongated overlap; and a third ribbon which extends continuously from the left side of the substrate to the right side of the substrate, which has an elongated front edge and which has an elongated rear edge which overlaps the front edge of the second ribbon at a second elongated overlap; and further comprising the steps of:

moving the frame and sprayer rearward, by a control device including a computer controlling operation of a travel advancement mechanism carried by the frame, while the sprayer is adjacent the left side of the substrate and while the sprayer is spraying the coating material onto the substrate so that the coating material applied to the substrate includes a left end segment which connects the first ribbon to the second ribbon along the left side of the substrate and which is substantially perpendicular to the first, second and third ribbons;

moving the frame and sprayer rearward, by the control device controlling operation of the travel advancement mechanism carried by the frame, while the sprayer is adjacent the right side of the substrate and while the sprayer is spraying the coating material onto the substrate so that the coating material applied to the substrate includes a right end segment which connects the second ribbon to the third ribbon along the right side of the substrate and which is substantially perpendicular to the first, second and third ribbons;

wherein the sprayer sprays continuously throughout the step of spraying and the steps of moving;

recording with a recording device data concerning application of the coating material, thereby producing recorded data;

generating with a computer program a report which includes the recorded data; and based on the recorded data of the report, certifying to an end user a coating job performed by the apparatus when the coating job meets desired specifications including that the coating material applied to the substrate has a uniform thickness throughout its entirety other than any variations at the first and second overlaps.

* * * * *